US012760673B2

(12) United States Patent
Masuda et al.

(10) Patent No.: US 12,760,673 B2
(45) Date of Patent: Oct. 13, 2026

(54) FLUE GAS TREATMENT DEVICE AND DESIGN METHOD OF FLUE GAS TREATMENT DEVICE

(71) Applicant: MITSUBISHI HEAVY INDUSTRIES, LTD., Tokyo (JP)

(72) Inventors: Tomotsugu Masuda, Tokyo (JP); Keiichiro Kai, Tokyo (JP); Shimpei Kaneda, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/881,473

(22) PCT Filed: May 26, 2023

(86) PCT No.: PCT/JP2023/019759
§ 371 (c)(1),
(2) Date: Jan. 6, 2025

(87) PCT Pub. No.: WO2024/009647
PCT Pub. Date: Jan. 11, 2024

(65) Prior Publication Data

US 2026/0002460 A1 Jan. 1, 2026

(30) Foreign Application Priority Data

Jul. 7, 2022 (JP) ..... 2022-109634
Sep. 27, 2022 (JP) ..... 2022-153605

(51) Int. Cl.
*F01N 3/20* (2006.01)

(52) U.S. Cl.
CPC ..... *F01N 3/2066* (2013.01); *F01N 2570/14* (2013.01); *F01N 2900/1402* (2013.01); *F01N 2900/1404* (2013.01)

(58) Field of Classification Search
CPC ..... F01N 3/2066; F01N 2570/14; F01N 2900/1402; F01N 2900/1404
See application file for complete search history.

(56) References Cited

U.S. PATENT DOCUMENTS 8,132,403 B2 * 3/2012 Toshioka ..... F01N 3/206 60/299
8,423,265 B2 * 4/2013 Aso ..... F01N 5/02 123/304

(Continued)

FOREIGN PATENT DOCUMENTS

CN 203892008 U 10/2014
CN 114526141 A 5/2022

(Continued)

OTHER PUBLICATIONS

Office Action dated Mar. 11, 2026, issued in counterpart EP Application No. 23835183.7. (8 pages).

(Continued)

*Primary Examiner* — Jesse S Bogue
(74) *Attorney, Agent, or Firm* — WHDA, LLP

(57) ABSTRACT

Provided is a flue gas treatment device configured to treat a flue gas discharged from a combustion device that combusts fuel containing ammonia, and the flue gas treatment device includes: an ammonia decomposition unit having an ammonia decomposition catalyst that decomposes ammonia contained in the flue gas; and a nitrogen oxide decomposition unit having a second catalyst that decomposes nitrous oxide and NOx contained in the flue gas in which ammonia was decomposed by the ammonia decomposition unit.

7 Claims, 17 Drawing Sheets

(56) References Cited

U.S. PATENT DOCUMENTS

| | | | | |
|---|---|---|---|---|
| 8,562,925 | B2 * | 10/2013 | Sarby | F01N 3/208 422/111 |
| 9,333,462 | B2 * | 5/2016 | Stenlåås | F01N 9/00 |
| 10,125,646 | B2 * | 11/2018 | Naseri | F01N 3/103 |
| 10,634,030 | B2 * | 4/2020 | Li | B01J 23/63 |
| 11,415,034 | B2 * | 8/2022 | Montgomery | F01N 13/0093 |
| 2005/0202966 | A1 * | 9/2005 | Jantsch | B01J 37/0242 423/239.1 |
| 2010/0281853 | A1 | 11/2010 | Toshioka et al. | |
| 2017/0226917 | A1 * | 8/2017 | Adam | F01N 11/002 |
| 2017/0292430 | A1 | 10/2017 | Clayton | |
| 2022/0162971 | A1 | 5/2022 | Montgomery | |
| 2025/0277466 | A1 * | 9/2025 | Collura | F01N 3/2066 |
| 2026/0002460 | A1 * | 1/2026 | Masuda | F01N 3/2066 |
| 2026/0015958 | A1 * | 1/2026 | Peitz | F01N 3/2066 |

FOREIGN PATENT DOCUMENTS

| | | | |
|---|---|---|---|
| CN | 114575971 | A | 6/2022 |
| JP | H04-363118 | A | 12/1992 |
| JP | 2006-026529 | A | 2/2006 |
| JP | 2007-154819 | A | 6/2007 |
| JP | 2020-090895 | A | 6/2020 |
| JP | 2022-064551 | A | 4/2022 |
| JP | 2023-026798 | A | 3/2023 |
| TW | 494794 | U | 7/2002 |

OTHER PUBLICATIONS

International Preliminary Report on Patentability (Form PCT/IPEA/409) issued in counterpart International Application No. PCT/JP2023/019759 dated Jun. 3, 2024, with English translation. (10 pages).

International Search Report dated Aug. 15, 2023, issued in counterpart Application No. PCT/JP2023/019759, with English translation. (9 pages).

Office Action dated Nov. 4, 2025, issued in counterpart JP Application No. 2024-531951, with English translation. (10 pages).

Partial (Supplementary) European Search Report dated Jul. 10, 2025, issued in counterpart EP Application No. 23835183.7. (21 pages).

Office Action dated Apr. 25, 2024, issued in counterpart TW Application No. 112119901. (11 pages).

* cited by examiner

FLUE GAS TREATMENT DEVICE AND DESIGN METHOD OF FLUE GAS TREATMENT DEVICE

TECHNICAL FIELD

The present disclosure relates to a flue gas treatment device and a design method of a flue gas treatment device.

BACKGROUND ART

In recent years, to suppress global warming, carbon neutrality is required to achieve, and application of ammonia fuel is considered as fuel that does not discharge carbon dioxide during combustion. When ammonia fuel is used, since not only NOx but also ammonia ($NH_3$), nitrous oxide ($N_2O$), and the like will be contained in a flue gas, it is required to remove these components from the flue gas to reduce impact on the environment.

Ammonia treatment devices that oxidize ammonia by using an ammonia decomposition catalyst and thereby decompose ammonia into nitrogen and water are conventionally known (for example, see Patent Literature 1).

CITATION LIST

Patent Literature

[PTL 1]
Japanese Patent Application Laid-Open No. 2006-26529

SUMMARY OF INVENTION

Technical Problem

With the art of Patent Literature 1, however, it is possible to decompose ammonia but not possible to decompose nitrous oxide when a gas to be treated contains nitrous oxide, for example.

Further, it is conventionally known to employ a selective catalytic reduction (SCR) to reduce NOx by spraying ammonia or urea water, which is a reducing agent, into a flue gas in order to decompose NOx contained in the flue gas or the like exhausted from a combustion device. In the SCR, however, while it is possible to decompose NOx but not possible to decompose nitrous oxide.

The present disclosure has been made in view of such circumstances and intends to provide a flue gas treatment device and a design method of a flue gas treatment device that can suitably decompose ammonia, nitrous oxide, and NOx contained in a flue gas from a combustion device that combusts fuel containing ammonia.

Solution to Problem

To solve the above problems, the present disclosure employs the following solutions.

A flue gas treatment device according to the present disclosure is a flue gas treatment device configured to treat a flue gas from a combustion device that combusts fuel containing ammonia, and the flue gas treatment device includes: a first treatment unit having a first catalyst that decomposes ammonia contained in the flue gas; and a second treatment unit having a second catalyst that decomposes nitrous oxide and NOx contained in the flue gas in which ammonia was decomposed by the first treatment unit.

A design method of a flue gas treatment device according to the present disclosure is a design method of a flue gas treatment device configured to treat a flue gas from a combustion device that combusts fuel containing ammonia, and the design method includes: designing the flue gas treatment device such that, when an concentration of ammonia contained in the flue gas is higher than a sum concentration of a first concentration and a second concentration, a first treatment unit having a first catalyst that decomposes ammonia contained in the flue gas is arranged downstream of the combustion device, and a second treatment unit having a second catalyst that decomposes nitrous oxide and NOx contained in the flue gas in which ammonia was decomposed by the first treatment unit is arranged downstream of the first treatment unit, the first concentration being obtained by multiplying a concentration of nitrous oxide contained in the flue gas by a first coefficient, and the second concentration being obtained by multiplying a concentration of NOx contained in the flue gas by a second coefficient; and designing the flue gas treatment device such that, when the concentration of ammonia contained in the flue gas is lower than or equal to the sum concentration, the second treatment unit is arranged without the first treatment unit being arranged downstream of the combustion device.

Advantageous Effects of Invention

According to the present disclosure, it is possible to provide a flue gas treatment device and a design method of a flue gas treatment device that can suitably decompose ammonia, nitrous oxide, and NOx contained in a flue gas from a combustion device that combusts fuel containing ammonia.

DESCRIPTION OF EMBODIMENTS

First Embodiment

A flue gas treatment device 100 according to a first embodiment of the present disclosure will be described below with reference to the drawings. The flue gas treatment device 100 of the present embodiment is a device to treat a flue gas from a combustion device 200 that combusts fuel containing ammonia and reduce ammonia, nitrous oxide, and NOx exhausted externally.

The combustion device 200 is a device that combusts fuel containing ammonia, for example, a marine diesel engine that generates propulsion of a ship. For example, the combustion device 200 of the present embodiment co-combusts ammonia and other fuel (heavy oil, liquefied natural gas (LNG), liquefied petroleum gas (LPG)). Further, the combustion device 200 may be a device that uses only ammonia as fuel, for example.

Since ammonia is used as fuel in the combustion device 200, a flue gas from the combustion device 200 contains unburned ammonia. Further, the flue gas from the combustion device 200 contains NOx (NO, $NO_2$) and nitrous oxide ($N_2O$) produced from combustion of ammonia and other fuel. The flue gas treatment device 100 of the present embodiment reduces ammonia, NOx. and nitrous oxide contained in the flue gas from the combustion device 200.

Figure 1:
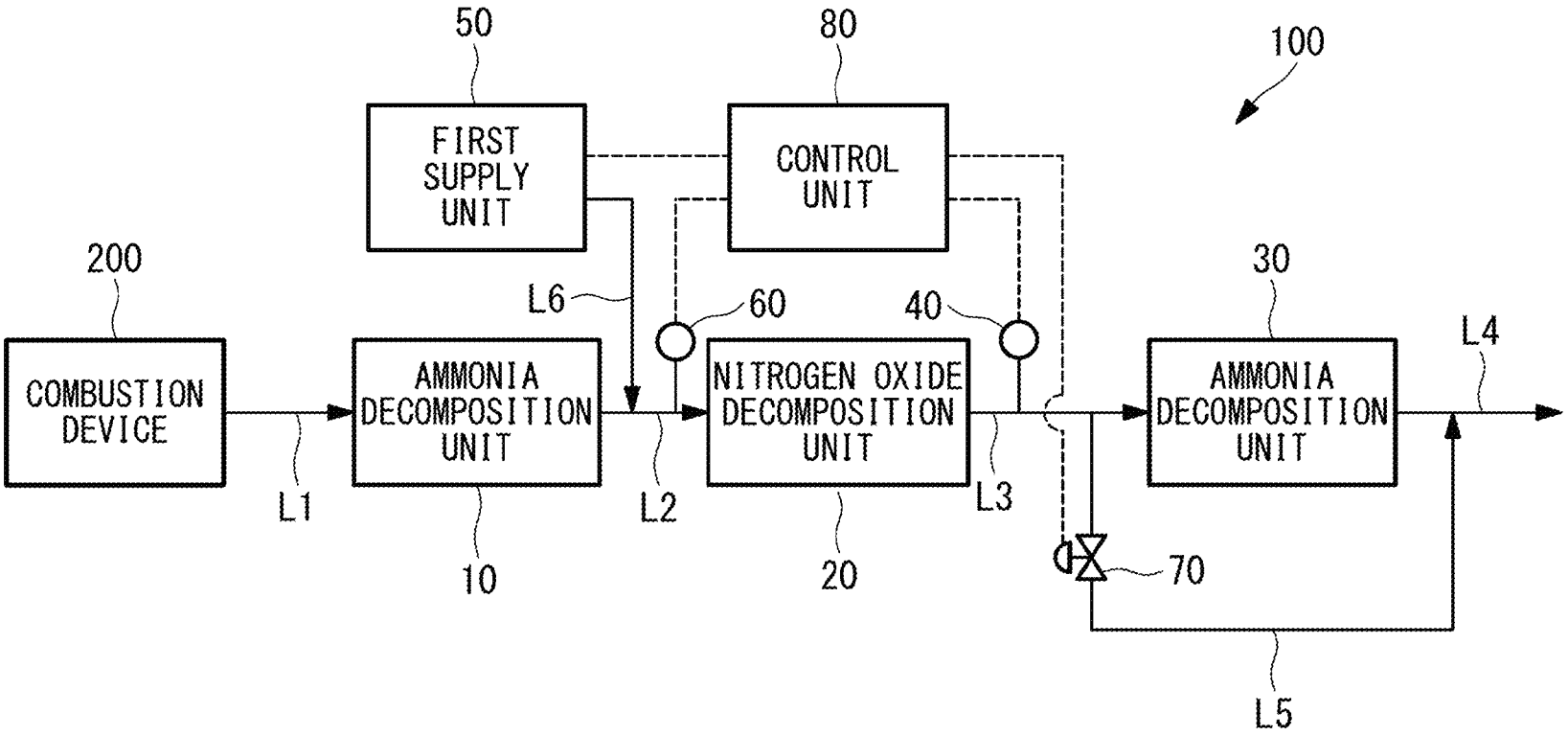
FIG. 1 is a schematic configuration diagram illustrating a flue gas treatment device according to a first embodiment of the present disclosure.

FIG. 1 is a schematic configuration diagram illustrating the flue gas treatment device according to the first embodiment of the present disclosure. As illustrated in FIG. 1, the flue gas treatment device 100 of the present embodiment includes an ammonia decomposition unit (first treatment unit) 10, a nitrogen oxide decomposition unit (second treatment unit) 20, an ammonia decomposition unit (third treatment unit) 30, a detection unit 40, a first supply unit 50 configured to supply ammonia or urea water that is a reducing agent, a temperature sensor 60, a bypass valve 70, and a control unit 80.

A flue gas from the combustion device 200 is supplied to the ammonia decomposition unit 10 via a pipe L1. The flue gas that has passed through the ammonia decomposition unit 10 is supplied to the nitrogen oxide decomposition unit 20 via a pipe L2. The flue gas that has passed through the nitrogen oxide decomposition unit 20 is supplied to the ammonia decomposition unit 30 via a pipe L3. The flue gas that has passed through the ammonia decomposition unit 30 is exhausted externally via a pipe L4. A part of the flue gas that has passed through the nitrogen oxide decomposition unit 20 is guided from the pipe L3 to the pipe L4 via the pipe L5 without passing through the ammonia decomposition unit 30 when the bypass valve 70 is opened.

Although the flue gas treatment device 100 of the present embodiment has the pipe L5 and the bypass valve 70, a modified example without these elements may be employed. In such a modified example, the whole amount of the flue gas that has passed through the nitrogen oxide decomposition unit 20 is guided to the ammonia decomposition unit 30.

The ammonia decomposition unit 10 has an ammonia decomposition catalyst (first catalyst) that decomposes ammonia contained in the flue gas from the combustion device 200. The ammonia decomposition catalyst is a multifunctional catalyst having functions of not only decomposing ammonia but also decomposing NOx and suppressing production of nitrous oxide. The ammonia decomposition catalyst of the present embodiment is a catalyst consisting of: a first component that is silica and zeolite carrying one or more types of noble metals selected from platinum (Pt), palladium (Pd), iridium (Ir), and rhodium (Rh); and a second component that is a composition consisting of oxide of one or more elements selected from titanium (Ti), tungsten (W), and vanadium (V). Examples of the ammonia decomposition catalyst will be described later.

The ammonia decomposition catalyst of the ammonia decomposition unit 10 decomposes $NH_3$ in accordance with the following formulae (1) and (2) because of the presence of the first component.

$$4NH_3 + 3O_2 \longrightarrow 2N_2 + 6H_2O \tag{1}$$

$$4NH_3 + 5O_2 \longrightarrow 4NO + 6H_2O \tag{2}$$

Further, the ammonia decomposition catalyst of the ammonia decomposition unit 10 decomposes $NH_3$ and removes at least a part of NO by-produced in formula (2) in accordance with the following formula (3) because of the presence of the second component.

$$4NH_3 + 4NO + O_2 \longrightarrow 4N_2 + 6H_2O \tag{3}$$

Further, in the ammonia decomposition catalyst of the ammonia decomposition unit 10, it is estimated that nitrous oxide ($N_2O$) is produced in accordance with formula (5) from $NO_2$ produced by oxidization of $NH_3$ in accordance with formula (4). In the ammonia decomposition catalyst, a small amount of a noble metal catalyst is present uniformly on a denitration catalyst. Thus, $NO_2$ produced on the noble metal catalyst, together with NO produced in formula (2), immediately reacts on the denitration catalyst into $N_2$ as in formula (6) with a high probability, and this can reduce by-production of $N_2O$.

$$4NH_3 + 7O_2 \longrightarrow 4NO_2 + 6H_2O \tag{4}$$

$$4NH_3 + 4NO_2 + O_2 \longrightarrow 4N_2O + 6H_2O \tag{5}$$

$$NO + NO_2 + 2NH_3 \longrightarrow 2N_2 + 3H_2O \tag{6}$$

The nitrogen oxide decomposition unit 20 has a nitrogen oxide decomposition catalyst (second catalyst) that decomposes nitrous oxide and NOx contained in the flue gas in which ammonia has been decomposed by the ammonia decomposition unit 10. The nitrogen oxide decomposition catalyst contains a carrier containing $SiO_2$ and $Al_2O_3$ and iron element carried thereby. In the carrier, $SiO_2$ and $Al_2O_3$ may be contained as a mixture or may be contained as a composite. The composite of $SiO_2$ and $Al_2O_3$ may be, for example, aluminosilicate ($xM_2O \cdot yAl_2O_3 \cdot zSiO_2 \cdot nH_2O$) or the like. Examples of the nitrogen oxide decomposition catalyst will be described later.

The nitrogen oxide decomposition catalyst of the nitrogen oxide decomposition unit 20 decomposes nitrous oxide via a reduction reaction with $NH_3$ in accordance with the following formula (7).

$$3N_2O + 2NH_3 \longrightarrow 4N_2 + 3H_2O \tag{7}$$

The nitrogen oxide decomposition catalyst of the nitrogen oxide decomposition unit 20 decomposes NOx via a reduction reaction with $NH_3$ in accordance with the following formulae (8), (9), (10).

$$4NO + 4NH_3 + O_2 \longrightarrow 4N_2 + 6H_2O \tag{8}$$

$$NO + NO_2 + 2NH_3 \longrightarrow 2N_2 + 3H_2O \tag{9}$$

$$6NO_2 + 8NH_3 \longrightarrow 7N_2 + 12H_2O \tag{10}$$

The ammonia decomposition unit 30 has an ammonia decomposition catalyst (third catalyst) that decomposes ammonia contained in the flue gas that has passed through the nitrogen oxide decomposition unit 20. The ammonia decomposition catalyst is a multi-functional catalyst having functions of not only decomposing ammonia but also decomposing NOx and suppressing production of nitrous oxide. The ammonia decomposition catalyst is a catalyst consisting of: a first component that is silica and zeolite carrying one or more types of noble metals selected from platinum (Pt), palladium (Pd), iridium (Ir), and rhodium (Rh); and a second component that is a composition consisting of oxide of one or more elements selected from titanium (Ti), tungsten (W), and vanadium (V). Since the configuration of the ammonia decomposition unit 30 is the same as the configuration of the ammonia decomposition unit 10, the description thereof will be omitted below.

The detection unit 40 is a device that determines concentrations of nitrous oxide and NOx contained in a flue gas that has passed through the ammonia decomposition unit 10. The detection unit 40 determines the concentrations of nitrous oxide and NOx contained in the flue gas passing through the pipe L3. The concentrations of nitrous oxide and NOx determined by the detection unit 40 are transmitted to the control unit 80.

The first supply unit 50 is a device that supplies ammonia or urea water, which is a reducing agent, into the flue gas supplied from the ammonia decomposition unit 10 to the nitrogen oxide decomposition unit 20. The first supply unit 50 supplies a reducing agent to the pipe L2 via a pipe L6 and mixes the reducing agent with the flue gas flowing through the pipe L2. For example, a reducing agent is sprayed by the pipe L6 into the pipe L2, and thereby the reducing agent is mixed with the flue gas. The first supply unit 50 adjusts the supply amount of the reducing agent supplied to the pipe L2 in accordance with a control signal transmitted from the control unit 80.

When urea water is supplied as the reducing agent, the urea water mixed with the flue gas in the pipe L2 is hydrolyzed in the flue gas, and thereby ammonia is produced. The nitrogen oxide decomposition catalyst of the nitrogen oxide decomposition unit 20 then decomposes NOx via a reduction reaction with ammonia ($NH_3$) in accordance with formulae (7), (8), (9) described above.

The temperature sensor 60 is a device that determines the temperature of a flue gas flowing through the pipe L2. The temperature sensor 60 transmits the determined flue gas temperature to the control unit 80.

The bypass valve 70 is an on-off valve arranged on the pipe L5. The open/close state of the bypass valve 70 is controlled by the control unit 80. When the bypass valve 70 is in an open state, the flue gas is guided from the pipe L3 to the pipe L4 via the pipe L5. When the bypass valve 70 is in a closed state, the flue gas is not guided to the pipe L5, and the whole amount of the flue gas flowing through the pipe L3 is guided to the pipe L4 via the ammonia decomposition unit 30.

The control unit 80 is a device that controls each unit of the flue gas treatment device 100. The control unit 80 controls each unit of the flue gas treatment device 100 by reading and executing a control program stored in a storage unit (not illustrated).

The control unit 80 controls the supply amount of the reducing agent, which is supplied by the first supply unit 50 to the pipe L2, in accordance with the concentrations of nitrous oxide and NOx determined by the detection unit 40 and the temperature of the flue gas determined by the temperature sensor 60. Further, the control unit 80 controls the open/close state of the bypass valve 70 in accordance with the concentrations of nitrous oxide and NOx determined by the detection unit 40 and the temperature of the flue gas determined by the temperature sensor 60.

Figure 2:
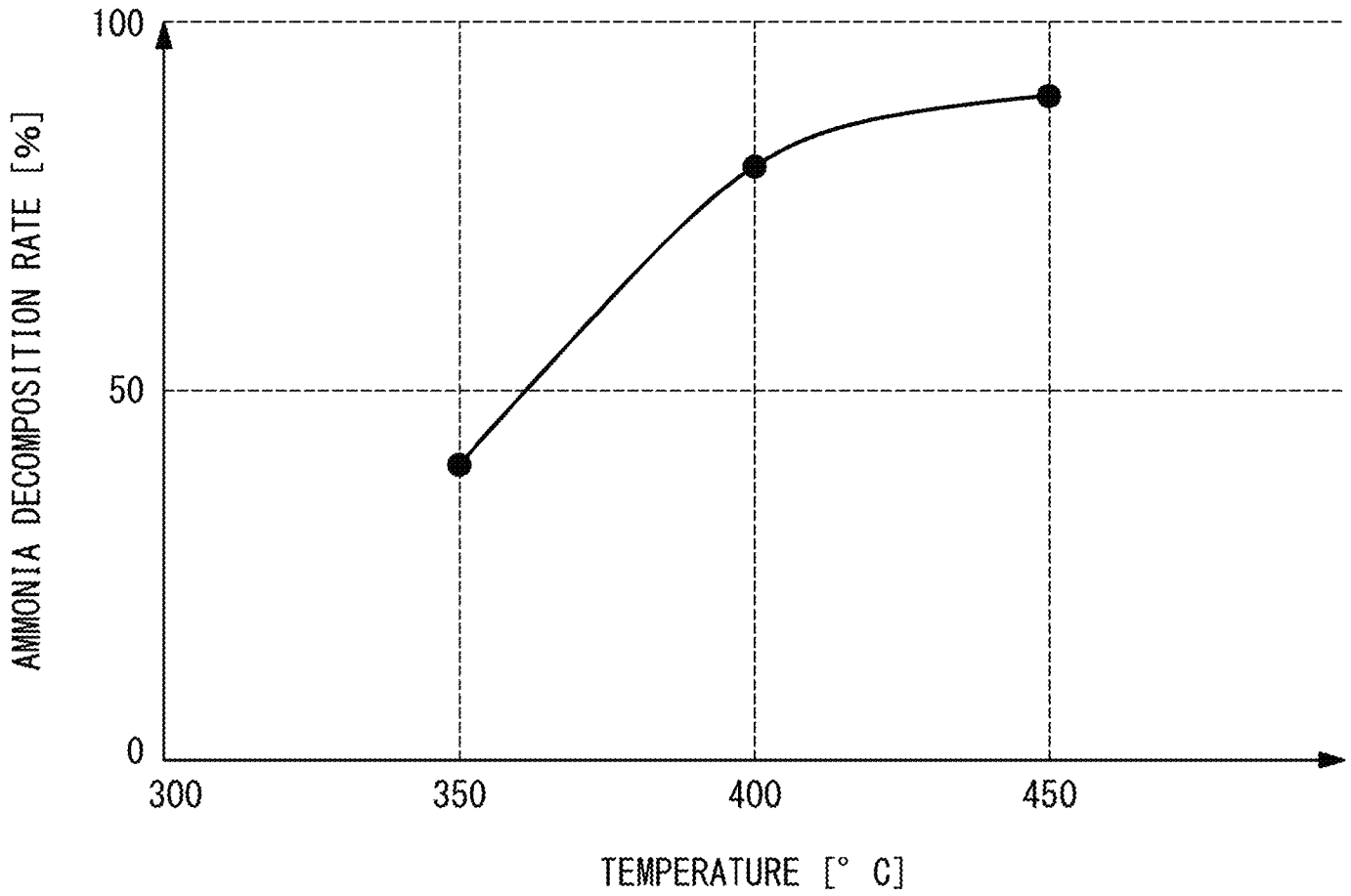
FIG. 2 is a graph illustrating decomposition characteristics of an ammonia decomposition catalyst.

Next, the decomposition characteristics of the ammonia decomposition catalyst of the ammonia decomposition unit 10 of the present embodiment will be described with reference to FIG. 2. FIG. 2 is a graph illustrating the decomposition characteristics of the ammonia decomposition catalyst. As illustrated in FIG. 2, as the temperature of the flue gas containing ammonia rises from 350° C. to 450° C., the ammonia decomposition rate [%] due to the ammonia decomposition catalyst of the ammonia decomposition unit 10 increases.

Figure 3:
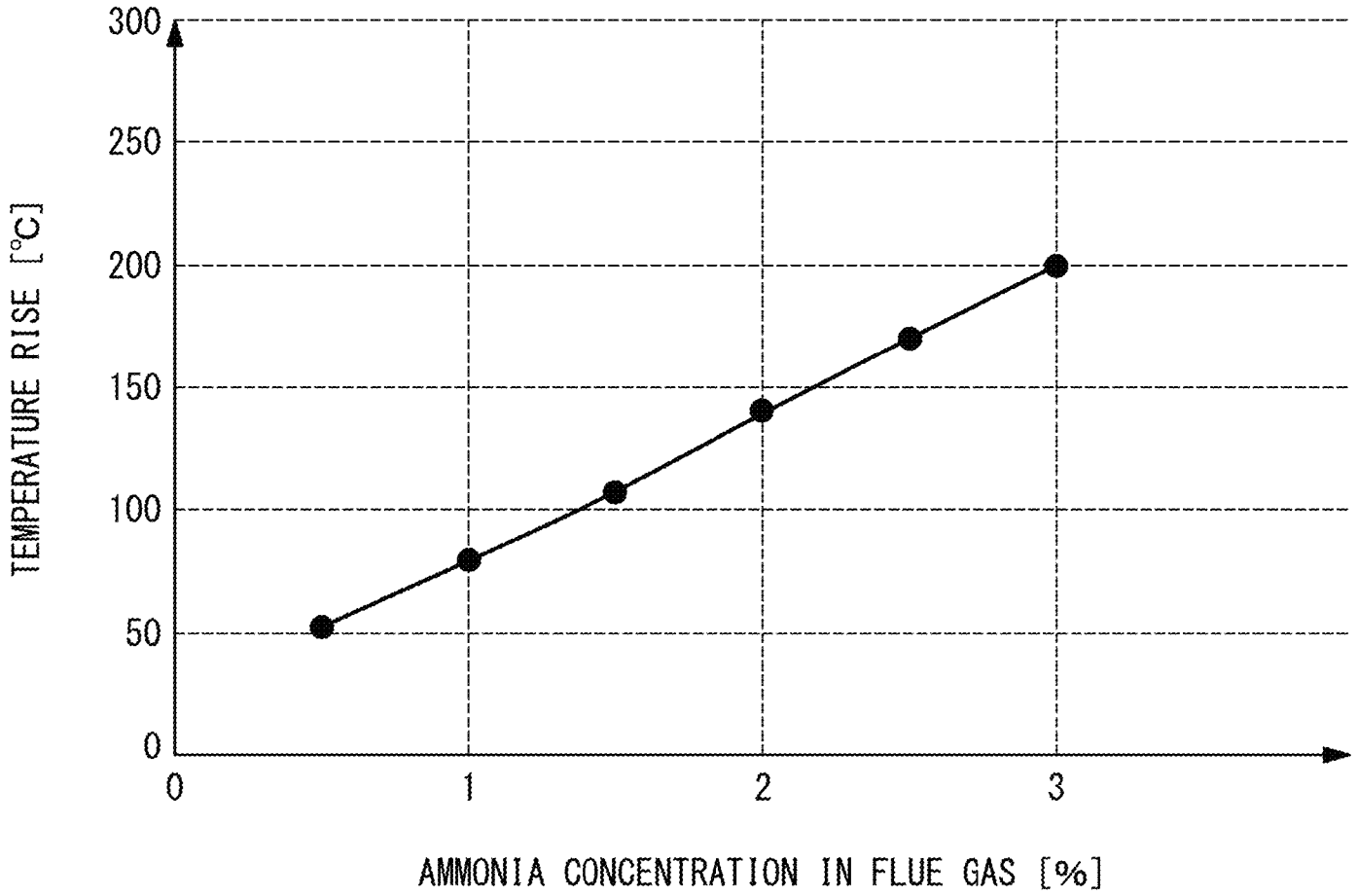
FIG. 3 is a graph illustrating a relationship between the ammonia concentration and rise in temperature in an ammonia decomposition catalyst.

Next, the relationship between the ammonia concentration and the rise in temperature in the ammonia decomposition catalyst of the ammonia decomposition unit 10 of the present embodiment will be described with reference to FIG. 3. FIG. 3 is a graph illustrating the relationship between the ammonia temperature and the rise in temperature in the ammonia decomposition catalyst.

As illustrated in FIG. 3, in the ammonia decomposition catalyst of the ammonia decomposition unit 10, as the concentration of unburned ammonia contained in the flue gas from the combustion device 200 increases, the rise in temperature of the flue gas increases due to heat generated during decomposition of ammonia. Combustion of unburned ammonia with the ammonia decomposition catalyst of the ammonia decomposition unit 10 can increase the temperature of the ammonia decomposition unit 10 and thereby increase the ammonia decomposition rate. Further, the temperature of the flue gas from the ammonia decomposition unit 10 can be increased.

Figure 4:
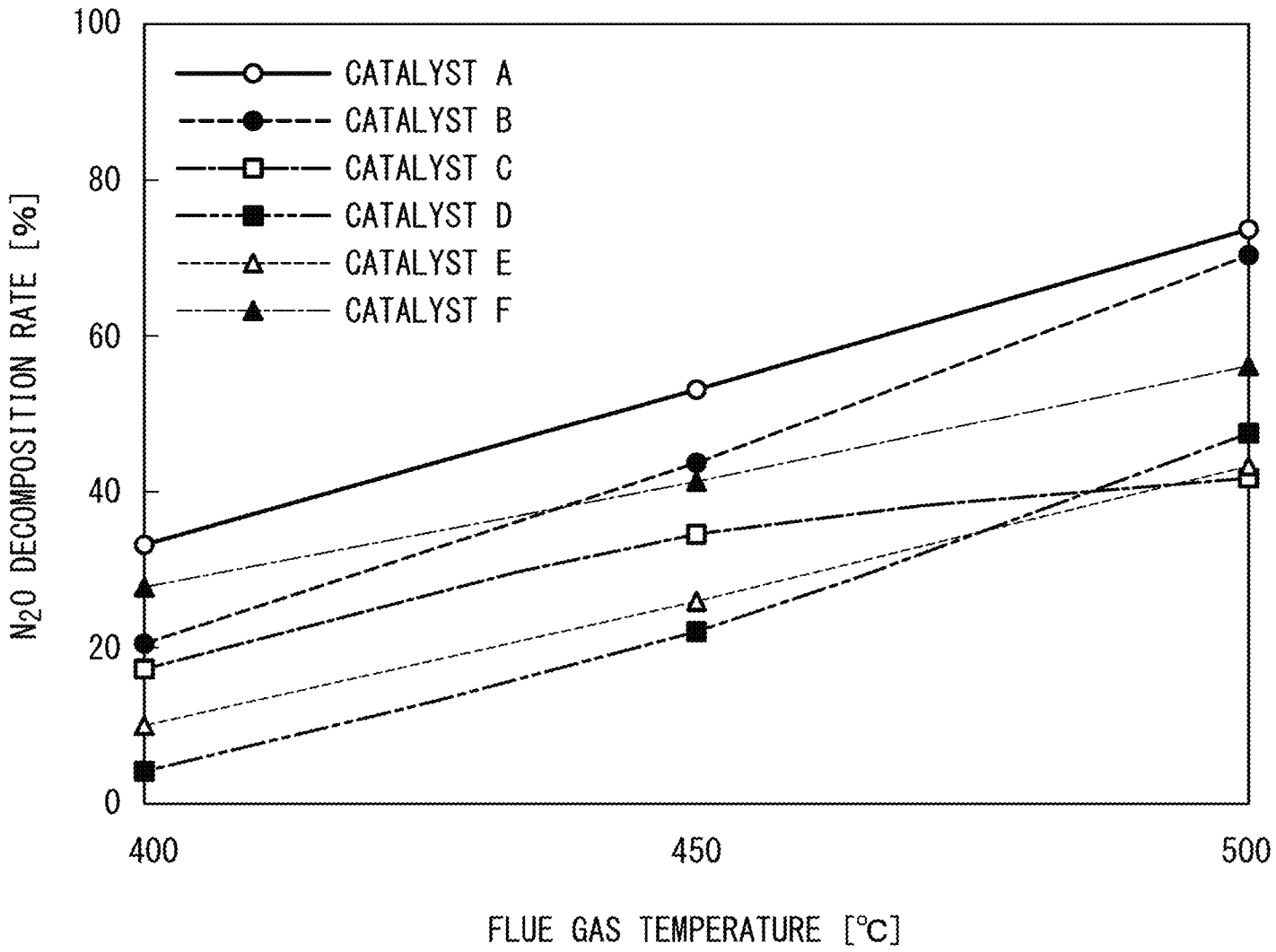
FIG. 4 is a graph illustrating decomposition characteristics for nitrous oxide with respect to the temperature of a flue gas.

Next, the decomposition characteristics for nitrous oxide with respect to the temperature of a flue gas will be described with reference to FIG. 4. FIG. 4 is a graph illustrating decomposition characteristics for nitrous oxide with respect to the temperature of the flue gas. Catalysts A to F illustrated in FIG. 4 correspond to catalysts A to F described in Examples of nitrogen oxide decomposition catalyst described later. As illustrated in FIG. 4, for all the catalysts A to F, as the temperature of the flue gas increases, the decomposition rate of nitrous oxide increases. Therefore, when ammonia is decomposed by the ammonia decomposition catalyst of the ammonia decomposition unit 10 to increase the temperature of the flue gas, the decomposition rate of nitrous oxide increases with the rise in temperature of the flue gas.

Figure 5:
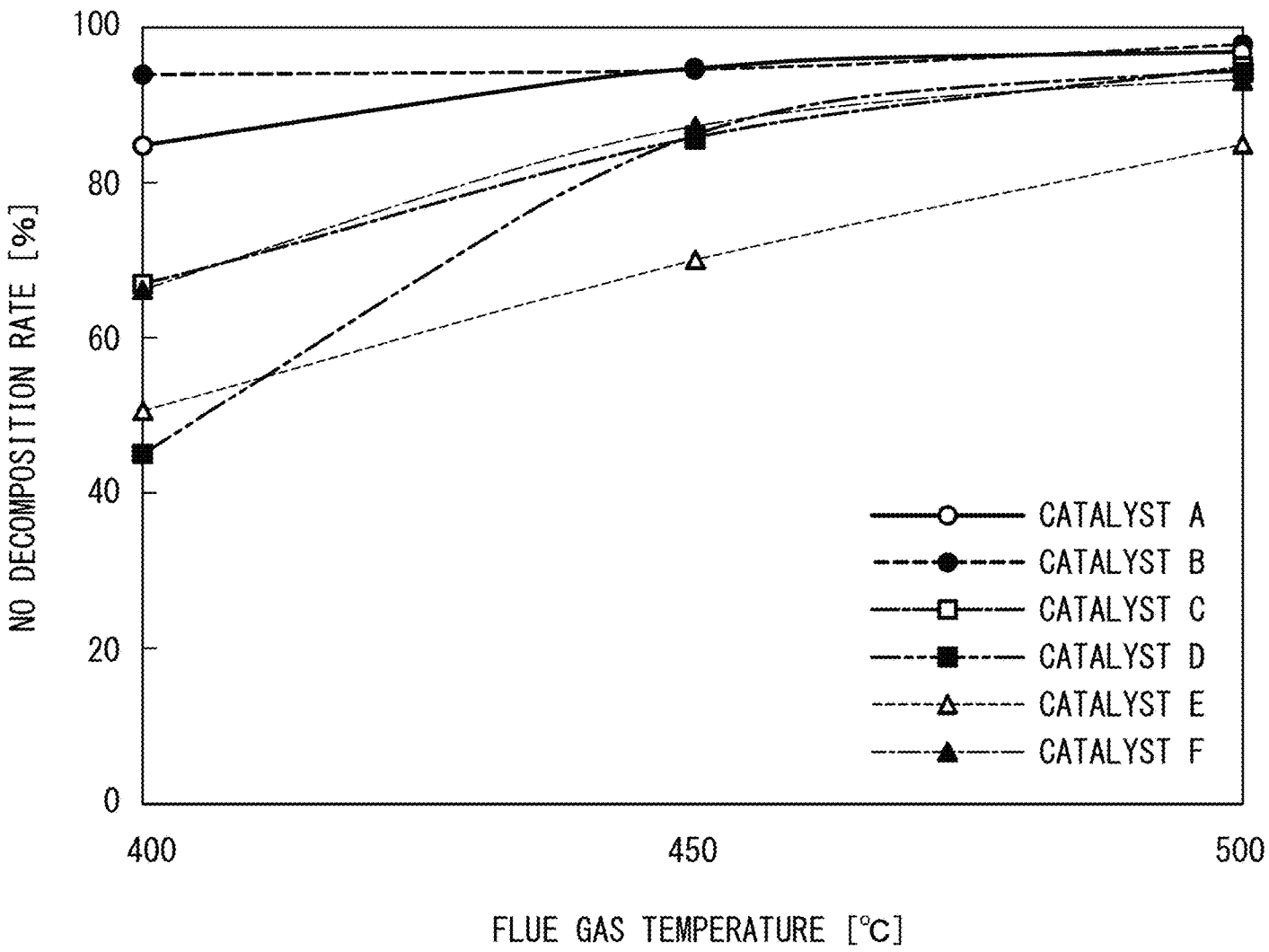
FIG. 5 is a graph illustrating decomposition characteristics for NO with respect to the temperature of a flue gas.

Next, the decomposition characteristics for NO with respect to the temperature of a flue gas will be described with reference to FIG. 5. FIG. 5 is a graph illustrating decomposition characteristics for NO with respect to the temperature of the flue gas. Catalysts A to F illustrated in FIG. 5 correspond to catalysts A to F described in Examples of nitrogen oxide decomposition catalyst described later. As illustrated in FIG. 5, for all the catalysts A to F, as the temperature of the flue gas increases, the decomposition rate of NO increases. Therefore, when ammonia is decomposed by the ammonia decomposition catalyst of the ammonia decomposition unit 10 to increase the temperature of the flue gas, the decomposition rate of NO increases with the rise in temperature of the flue gas.

In the present embodiment, the reason why the ammonia decomposition unit 10 is installed upstream of the nitrogen oxide decomposition unit 20 is that the supply amount of unburned ammonia contained in the flue gas from the combustion device 200 is assumed to be larger than the amount of ammonia required to decompose nitrous oxide and NOx in the nitrogen oxide decomposition unit 20. The flue gas treatment device 100 of the present embodiment decomposes excessive ammonia in the ammonia decomposition unit 10, increases the temperature of the flue gas by using heat generated in the decomposition of ammonia, and thereby increases the decomposition rate of nitrous oxide and NOx in the nitrogen oxide decomposition unit 20.

The flue gas treatment device 100 of the present embodiment assumes that the concentrations of ammonia, nitrous oxide, and NOx contained in the flue gas from the combustion device 200 satisfy the following formula (11), respectively.

$$\text{anmonia concentration} > \alpha \times \text{nitrous oxide concentration} + \beta \times NOx \text{ concentration} \quad (11)$$

Herein, α and β are coefficients, for example, α=1.0 and β=1.5. The coefficient α=1.0 is based on the value obtained by multiplying the molar ratio of ammonia/nitrous oxide in the reaction of formula (7) (ammonia/nitrous oxide=2/3) by 1.5. The coefficient β=1.5 is based on the value obtained by multiplying the molar ratio of ammonia/NO in the reaction of formula (8) (ammonia/NO=1/1) by 1.5. Note that the numerical values multiplied by α, β are not limited to 1.5 and may be set to any numerical value greater than or equal to 1.2 and less than or equal to 2.0 in accordance with the property of the flue gas from the combustion device 200, for example.

However, for example, when the amount of the flue gas from the flue gas treatment device 100 or the amount of ammonia contained in the flue gas is smaller than expected, the whole amount of unburned ammonia is decomposed in the ammonia decomposition unit 10, and ammonia required as the reducing agent in the nitrogen oxide decomposition unit 20 will be insufficient. Accordingly, in the present embodiment, when ammonia required as the reducing agent in the nitrogen oxide decomposition unit 20 becomes insufficient, a reducing agent is supplied from the first supply unit 50 to compensate for the shortage of ammonia in the nitrogen oxide decomposition unit 20.

Figure 6:
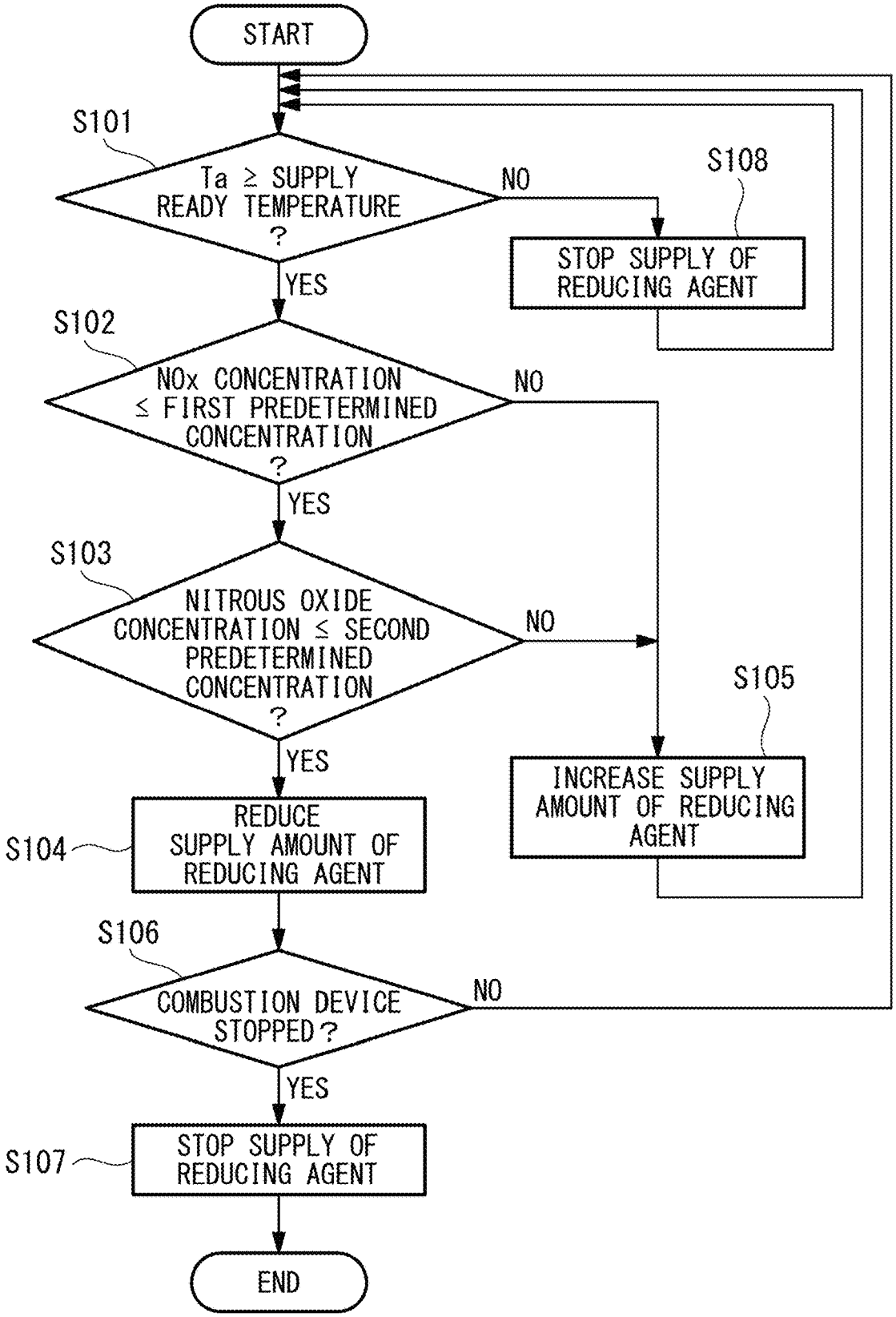
FIG. 6 is a flowchart illustrating a process of supplying a reducing agent in the flue gas treatment device according to the first embodiment of the present disclosure.

Next, a process of supplying a reducing agent in the flue gas treatment device 100 of the present embodiment will be described with reference to FIG. 6. FIG. 6 is a flowchart illustrating the process of supplying a reducing agent in the flue gas treatment device 100 of the present embodiment. The process of each step of FIG. 6 is performed by the control unit 80 controlling each unit of the flue gas treatment device 100. In response to start of a combustion operation by the combustion device 200, the process of the present flowchart is started.

In step S101, the control unit 80 determines whether or not the temperature Ta of a flue gas flowing through the pipe L2 transmitted from the temperature sensor 60 is higher than or equal to a supply ready temperature (for example, 350° C.) at which a reducing agent is ready to be supplied to the nitrogen oxide decomposition unit 20. If the determination is YES, the control unit 80 proceeds with the process to step S102, and if the determination is NO, the control unit 80 proceeds with the process to step S108.

In step S108, since the temperature Ta of the flue gas flowing through the pipe L2 is lower than the supply ready temperature at which the reducing agent is ready to be supplied to the nitrogen oxide decomposition unit 20, the control unit 80 performs control to stop supply of the reducing agent from the first supply unit 50.

In step S102, the control unit 80 determines whether or not the NOx concentration determined by the detection unit 40 is lower than or equal to a first predetermined concentration (for example, 200 ppm). If the determination is YES, the control unit 80 proceeds with the process to step S103, and if the determination is NO, the control unit 80 proceeds with the process to step S105.

In step S103, the control unit 80 determines whether or not the nitrous oxide concentration determined by the detection unit 40 is lower than or equal to a second predetermined concentration (for example, 50 ppm). If the determination is YES, the control unit 80 proceeds with the process to step S104, and if the determination is NO, the control unit 80 proceeds with the process to step S105.

In step S104, since the NOx concentration is lower than or equal to the first predetermined concentration and the nitrous oxide concentration is lower than or equal to the second predetermined concentration, the control unit 80 determines that the reduction treatment on NOx and nitrous oxide by ammonia has been suitably performed and controls the first supply unit 50 to reduce the amount of reducing agent supply.

In step S105, since the NOx concentration is higher than the first predetermined concentration or the nitrous oxide concentration is higher than the second predetermined concentration, the control unit 80 determines that the reduction treatment on NOx and nitrous oxide by ammonia is not sufficiently performed, controls the first supply unit 50 to increase the amount of reducing agent supply, and proceeds with the process to step S101.

In step S106, the control unit 80 determines whether or not the combustion device 200 is stopped. If the determination is YES, the control unit 80 proceeds with the process to step S107, and if the determination is NO, the control unit 80 performs step S101 again. The combustion device 200 transmits the operation state including the combustion operation stop state to the control unit 80.

In step S107, since the combustion device 200 is stopped, the control unit 80 determines that the reduction treatment on NOx and nitrous oxide by ammonia is unnecessary, stops supply of the reducing agent from the first supply unit 50, and ends the process of the present flowchart. In response to the combustion device 200 starting a combustion operation, the control unit 80 restarts the process of the present flowchart.

Figure 7:
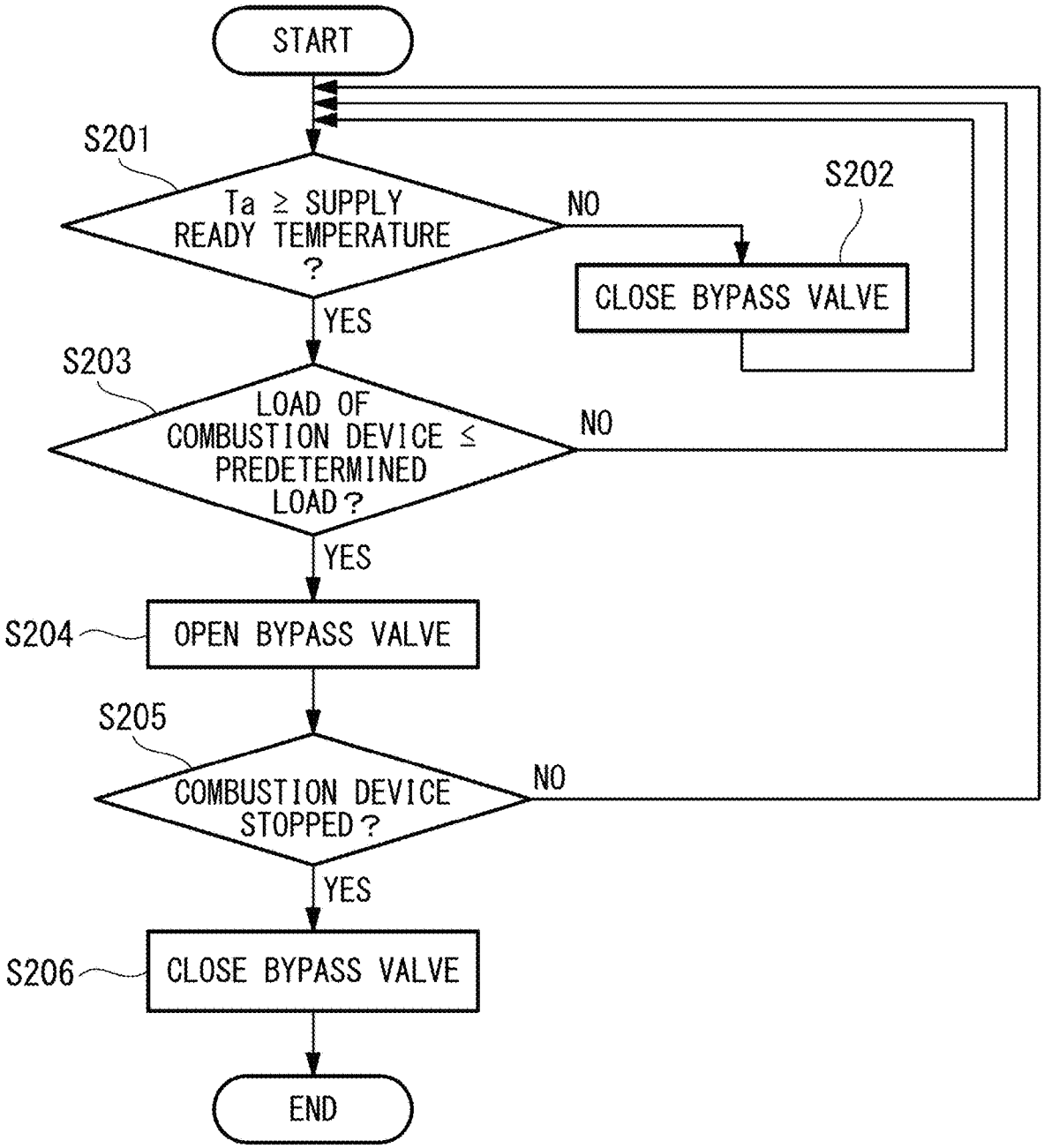
FIG. 7 is a flowchart illustrating a process of switching a bypass valve in the flue gas treatment device according to the first embodiment of the present disclosure.

Next, a process of switching the bypass valve 70 in the flue gas treatment device 100 of the present embodiment will be described with reference to FIG. 7. FIG. 7 is a flowchart illustrating the process of switching the bypass valve 70 in the flue gas treatment device 100 of the present embodiment. The process of each step of FIG. 7 is performed by the control unit 80 controlling each unit of the flue gas treatment device 100. In response to start of a combustion operation by the combustion device 200, the process of the present flowchart is started.

In the flue gas treatment device 100 of the present embodiment, the ammonia decomposition unit 30 is arranged downstream of the nitrogen oxide decomposition unit 20. The ammonia decomposition unit 30 is provided for ensuring decomposition of excessive ammonia and preventing discharge of ammonia to outside when the concentration of ammonia contained in the flue gas from the combustion device 200 is higher than an expected concentration and ammonia is not completely decomposed in the ammonia decomposition unit 10 and the nitrogen oxide decomposition unit 20, for example.

In the ammonia decomposition unit 30, however, when the concentration of ammonia contained in the flue gas from the nitrogen oxide decomposition unit 20 is lower than or equal to a predetermined acceptable concentration, it is not necessary to treat the flue gas in the ammonia decomposition unit 30, and the flue gas will cause a pressure loss when passing through the ammonia decomposition unit 30. Accordingly, in the present embodiment, when the concentration of ammonia contained in the flue gas from the nitrogen oxide decomposition unit 20 is lower than or equal to a predetermined acceptable concentration, a part of the flue gas from the nitrogen oxide decomposition unit 20 is guided to the pipe L5 to prevent a pressure loss from occurring when the flue gas passes through the ammonia decomposition unit 30.

In step S201, the control unit 80 determines whether or not the temperature Ta of a flue gas flowing through the pipe L2 transmitted from the temperature sensor 60 is higher than or equal to a supply ready temperature (for example, 350° C.) at which a reducing agent is ready to be supplied to the nitrogen oxide decomposition unit 20. If the determination is YES, the control unit 80 proceeds with the process to step S203, and if the determination is NO, the control unit 80 proceeds with the process to step S202.

In step S202, since the temperature Ta of the flue gas flowing through the pipe L2 is lower than the supply ready temperature at which the reducing agent is ready to be supplied to the nitrogen oxide decomposition unit 20 and the temperature of the flue gas from the combustion device 200 has not yet increased to a suitable temperature, the control unit 80 controls the bypass valve 70 into the closed state.

In step S203, the control unit 80 determines whether or not the load of the combustion device 200 is lower than or equal to a predetermined load (for example, 50% load). If the determination is YES, the control unit 80 proceeds with the process to step S204, and if the determination is NO, the control unit 80 performs step S201 again. The combustion device 200 transmits the load of the combustion operation to the control unit 80.

In step S204, since the load of the combustion device 200 is lower than or equal to the predetermined load, the control unit 80 controls the bypass valve 70 into the open state. When the load of the combustion device 200 is lower than or equal to the predetermined load, the concentration of ammonia contained in the flue gas from the nitrogen oxide decomposition unit 20 is lower than or equal to a predetermined acceptable concentration (for example, 5 ppm), and it is not necessary to treat the flue gas in the ammonia decomposition unit 30. Accordingly, to reduce generation of a pressure loss caused when the flue gas passes through the ammonia decomposition unit 30, a part of the flue gas flowing through the pipe L3 is guided from the pipe L5 to the pipe L4.

In step S205, the control unit 80 determines whether or not the combustion device 200 is stopped. If the determination is YES, the control unit 80 proceeds with the process to step S206, and if the determination is NO, the control unit 80 performs step S201 again. The combustion device 200 transmits the operation state including the combustion operation stop state to the control unit 80.

In step S206, since the combustion device 200 is stopped, the control unit 80 closes the bypass valve 70 and ends the process of the present flowchart. In response to the combustion device 200 starting a combustion operation, the control unit 80 restarts the process of the present flowchart.

Although the detection unit 40 determines the concentrations of nitrous oxide and NOx contained in the flue gas that has passed through the ammonia decomposition unit 10 in the above description, other forms may be employed. The detection unit 40 may be to determine the concentration of either nitrous oxide or NOx contained in the flue gas that has passed through the ammonia decomposition unit 10. When the detection unit 40 determines the concentration of nitrous oxide, the process of step S102 of FIG. 6 is omitted. Further, when the detection unit 40 determines the concentration of NOx, the process of step S103 of FIG. 6 is omitted.

[Example of Ammonia Decomposition Catalyst]

The ammonia decomposition catalyst of the ammonia decomposition unit 10 of the present embodiment is obtained by any of the following Examples, for example.

Example 1

First, 100 g of fine silica powder (Tomita Pharmaceuticals, silicic acid anhydride) was added to 1 litter, $1.33\times10^{-2}$ wt % of chloroplatinic acid ($H_2[PtCl_6]\cdot6H_2O$) aqueous solution, the mixture was evaporated to dryness on a sand bath and sintered in air at 500° C. for 2 hours to prepare 0.05 wt % of $Pt\cdot SiO_2$, and thereby catalyst composition powder of the first component was obtained.

On the other hand, 7.43 kg of ammonium paratungstate ($(NH_4)_{10}\cdot W_{12}O_{41}\cdot5H_2O$) and 3.0 kg of ammonium metavanadate were added to 46.7 kg of titanium dioxide powder (product name, MCH, $SO_4$ content: 3 wt %, manufactured by Ishihara Sangyo Co.), the mixture was kneaded by using a kneader, and the obtained paste was dried after granulation and sintered at 550° C. for 2 hours. The obtained granules were pulverized, and thereby catalyst composition powder of the second component was obtained. The composition is Ti/W/V=91/5/4 (atom ratio).

After slurry obtained by suspending 20 g of the first component and 2.02 kg of the second component in 3.06 kg of water was immersed in a paper honeycomb carrier (product name: HONEYCLE 3722, 150 mm×150 mm square, 50 mm in length, manufactured by NICHIAS Corporation) to impregnate the carrier with the slurry, the liquid was removed by air blow, and thereby the catalyst of the present Example was obtained. This catalyst was air-dried in the atmosphere for 12 hours and then sintered at 500° C. for 2 hours. The first component/second component ratio between the first component and the second component in the present catalyst was 1/99 (weight ratio, the same applies hereafter), the Pt content in the catalyst component corresponded to 5 ppm, and the amount of the coated catalyst was 150 g/m$^2$ per carrier surface area for the first component and the second component in combination. Pieces of 5 levels×8 cells (11×14 mm) and 50 nm in length were cut out from the obtained honeycomb catalyst to obtain test pieces.

Example 2

A catalyst of the present Example was obtained in the same manner as in Example 1 except that the amounts of the first component, the second component, and water of Example 1 were changed to 10 g, 2.02 kg, and 3.04 kg, respectively. The first component/second component ratio between the first component and the second component in the present catalyst was 0.5/99.5, the Pt content in the catalyst component corresponded to 2.5 ppm, and the amount of the carried catalyst was 150 g/m$^2$ per carrier surface area for the first component and the second component in combination.

Examples 3 to 5

The first component and the second component obtained in Example 1 were used, the amounts of water addition during slurry preparation were changed to 476 and 816 kg, respectively, the obtained slurry was carried by a paper honeycomb carrier (product name: HONEYCLE 3319, 150 mm×150 mm square, 50 mm in length, manufactured by NICHIAS Corporation) in the same manner as in Example 1, and thereby catalysts of the present Examples were obtained. The first component/second component ratio between the first component and the second component in the present catalysts were 1/99, and the Pt content in the catalyst component corresponded to 5 ppm. The amounts of the coated catalyst of Examples 3 to 5 were 100, 80, and 50 g/m$^2$ per carrier surface area, respectively, for the first component and the second component in combination.

Example 6

A catalyst of the present Example was obtained in the same manner as in Example 1 except that the paper honeycomb carrier of Example 1 was changed to a metal lath (SUS304, 0.2 mmt in plate thickness, 150 mm×150 nm square). The first component/second component ratio between the first component and the second component in the present catalyst was 1/99, and the Pt content in the catalyst component corresponded to 5 ppm. The amount of the coated catalyst was 200 g/m$^2$ per carrier surface area for the first component and the second component in combination.

Example 7

A catalyst of the present Example was obtained in the same manner as above except that the water for preparing the slurry of Example 1 was changed to colloidal silica (product name: OS sol, $SiO_2$ content: 20%, manufactured by Nissan Chemical Co.)/water=3/7.

Example 8

After 20 g of the first component prepared in Example 1 is suspended in 1000 g of a liquid of colloidal silica/water=3/7 and this was immersed in a paper honeycomb carrier to impregnate the carrier with the slurry, the liquid was removed by air blow, and the remaining was air-dried in the atmosphere for 12 hours and then sintered at 500° C. for 2 hours. The obtained catalyst was immersed in the slurry obtained by suspending 2.02 kg of the second component of Example 1 in 3.06 kg of water, the liquid was then removed, the remaining was then air-dried and sintered at 500° C. for 2 hours, and thereby the catalyst of the present Example was prepared.

[Example of Nitrogen Oxide Decomposition Catalyst]

The nitrogen oxide decomposition catalyst of the nitrogen oxide decomposition unit 20 of the present embodiment is any of the following catalysts A to E, for example.

Catalyst A

<Carrying Step (Ion Exchange)>

First, 60 g of BEA type zeolite ($SiO_2/Al_2O_3$ ratio=25) was put into 2000 ml of an aqueous solution containing 13.2 g of iron (I) nitrate nonahydrate ($Fe_2(NO_2)_2 \cdot 9H_2O$) heated at 80° C., then the mixture was stirred for 3 hours while maintained at a temperature of 80° C., and thereby slurry was obtained. Dehydration was performed on the slurry with use of a suction funnel to which filter paper (No. 5C) was attached. A predetermined amount of pure water was poured to the cake on the filter paper to wash the cake. The washed cake was dried at 110° C. for 12 hours and sintered at 500° C. for 5 hours. The sintered product was pulverized by a planetary ball mill, and thereby a powder Fe-carrying zeolite catalyst A was obtained.

<Honeycomb Coating Step>

The Fe-carrying zeolite catalyst A was put into pure water, the mixture was then stirred, and thereby catalyst slurry was obtained. The catalyst slurry was coated to a honeycomb substrate for coating amount of 70 g/m$^2$. This is dried at 120° C. for 2 hours and then sintered at 500° C. for 2 hours, and thereby a honeycomb catalyst A was obtained.

Catalyst B

A powder Fe-carrying zeolite catalyst B and a honeycomb catalyst B were obtained by the same manufacturing method as for the catalyst A except that BEA type zeolite ($SiO_2/Al_2O_3$ ratio=25) was replaced with BEA type zeolite ($SiO_2/Al_2O_3$ ratio=28).

Catalyst C

A powder Fe-carrying zeolite catalyst C and a honeycomb catalyst C were obtained by the same manufacturing method as for the catalyst A except that BEA type zeolite ($SiO_2/Al_2O_3$ ratio=25) was replaced with BEA type zeolite ($SiO_2/Al_2O_3$ ratio=7.5).

Catalyst D

First, 60 g of CHA type zeolite ($SiO_2/Al_2O_3$ ratio=24) was put into 2000 ml of an aqueous solution containing 13.2 g of iron (III) nitrate nonahydrate ($Fe_2(NO_3)_3 \cdot 9H_2O$) heated at 80° C., then the mixture was stirred for 3 hours while maintained at a temperature of 80° C., and thereby slurry was obtained. The slurry was filtrated with use of a suction funnel to which filter paper (No. 5C) was attached. A predetermined amount of pure water was poured to the cake on the filter paper to wash the cake. The washed cake was dried at 110° C. for 12 hours and sintered at 500° C. for 5 hours. The sintered product was pulverized by a planetary ball mill to obtain powder.

This powder was put into 2000 ml of an aqueous solution containing 13.2 g of iron (III) nitrate nonahydrate ($Fe_2(NO_3)_3 \cdot 9H_2O$), the above operation was performed another two times (in total three times of the ion exchange step), and thereby a powder Fe-carrying zeolite catalyst D was obtained. A honeycomb catalyst D was obtained by the same manufacturing method as for the catalyst A except that the Fe-carrying zeolite catalyst A was replaced with the Fe-carrying zeolite catalyst D.

Catalyst E

A powder Fe-carrying zeolite catalyst E and a honeycomb catalyst E were obtained by the same manufacturing method as for the catalyst A except that BEA type zeolite ($SiO_2/Al_2O_3$ ratio=25) was replaced with MFI type zeolite ($SiO_2/Al_2O_3$ ratio=30).

Catalyst F

A powder Fe-carrying zeolite catalyst F and a honeycomb catalyst F were obtained by the same manufacturing method as for the catalyst A except that BEA type zeolite ($SiO_2/Al_2O_3$ ratio=25) was replaced with BEA type zeolite ($SiO_2/Al_2O_3$ ratio=24).

The effects and advantages achieved by the flue gas treatment device 100 of the present embodiment described above will be described.

According to the flue gas treatment device 100 of the present disclosure, ammonia contained in a flue gas from the combustion device 200 is suitably decomposed by an ammonia decomposition catalyst when passing through the ammonia decomposition unit 10. Further, nitrous oxide and NOx produced when ammonia is combusted in the combustion device 200 are suitably decomposed by a nitrogen oxide decomposition catalyst when passing through the nitrogen oxide decomposition unit 20. As described above, according to the flue gas treatment device 100 of the present disclosure, ammonia and nitrous oxide contained in a flue gas from the combustion device 200 that combusts fuel containing ammonia can be suitably decomposed.

According to the flue gas treatment device 100 of the present embodiment, even when ammonia remains in the flue gas that has passed through the nitrogen oxide decomposition unit 20, ammonia is decomposed in the ammonia decomposition unit 30, and this can prevent ammonia from being exhausted externally.

According to the flue gas treatment device 100 of the present embodiment, when the detection unit 40 determines that the concentration of nitrous oxide contained in the flue gas that has passed through the nitrogen oxide decomposition unit 20 is higher than a first predetermined concentration or that the concentration of NOx contained in the flue gas that has passed through the nitrogen oxide decomposition unit 20 is higher than a second predetermined concentration, a reducing agent is supplied from the first supply unit 50 into the flue gas supplied to the nitrogen oxide decomposition unit 20 in order to compensate for shortage of ammonia used for reducing nitrous oxide and NOx. Thus, shortage of ammonia supplied from the ammonia decomposition unit 10 to the nitrogen oxide decomposition unit 20 is compensated, and the concentration of nitrous oxide and the concentration of NOx contained in the flue gas that has passed through the nitrogen oxide decomposition unit 20 can be reduced.

Second Embodiment

A flue gas treatment device 100A of a second embodiment of the present disclosure will be described below with reference to the drawings. The flue gas treatment device 100A of the present embodiment is a modified example for the flue gas treatment device 100 of the first embodiment and, except as specifically described below, is the same as that of the first embodiment, and the description thereof will be omitted below.

The flue gas treatment device 100A of the present embodiment differs from the flue gas treatment device 100 of the first embodiment in that the flue gas treatment device 100A has a pipe (bypass pipe) L7, which guides a part of a flue gas flowing through the pipe L1 to the pipe L2, and a bypass valve 90 arranged on the pipe L7.

Figure 8:
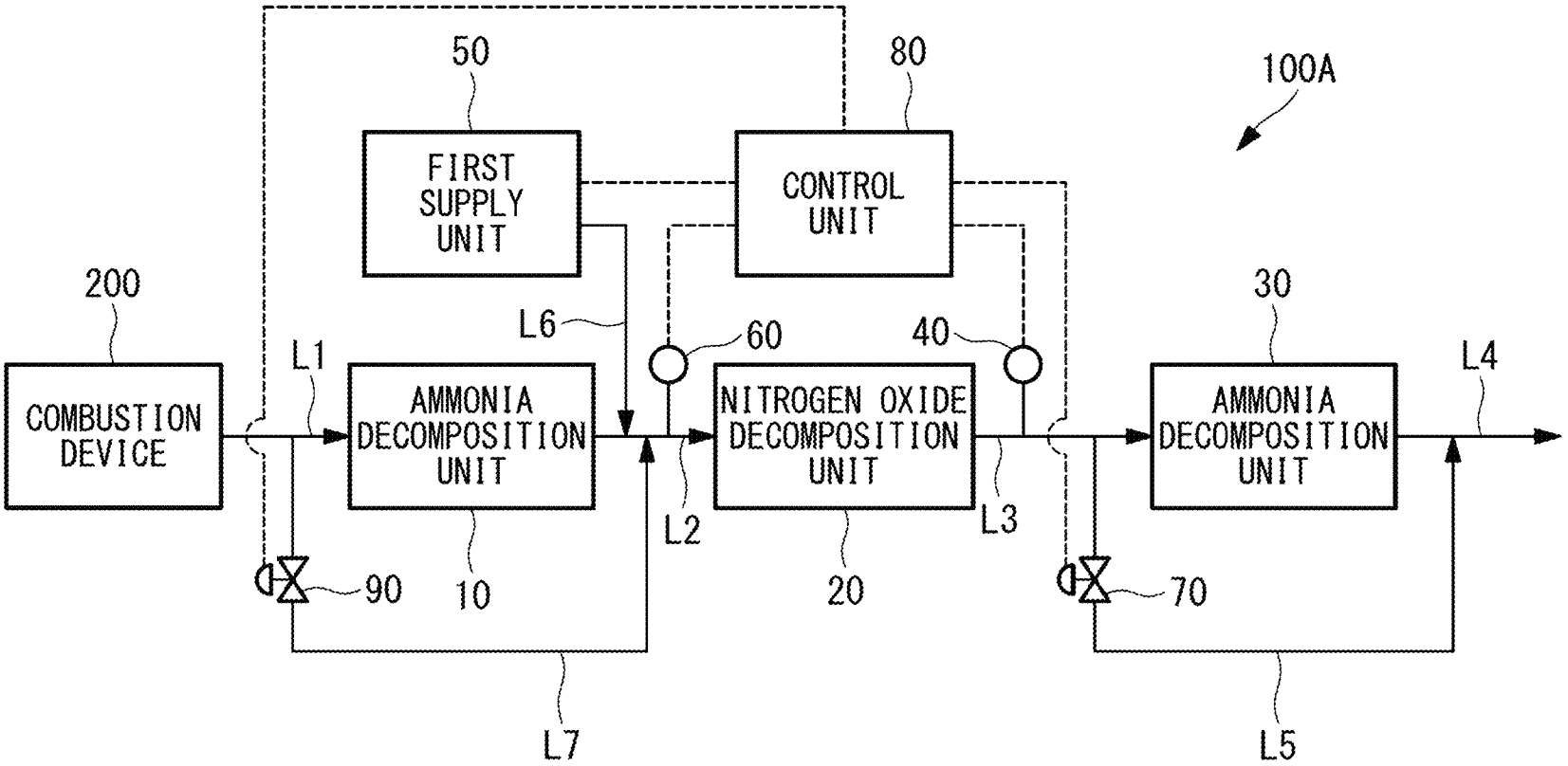
FIG. 8 is a schematic configuration diagram illustrating a flue gas treatment device according to a second embodiment of the present disclosure.

FIG. 8 is a schematic configuration diagram illustrating the flue gas treatment device 100A according to the second embodiment of the present disclosure. As illustrated in FIG. 8, the flue gas treatment device 100A of the present embodiment has the pipe L7, which guides a part of the flue gas flowing through the pipe L1 to the pipe L2, and the bypass valve 90 arranged on the pipe L7.

The bypass valve 90 is an on-off valve arranged on the pipe L7. The open/close state of the bypass valve 90 is controlled by the control unit 80. When the bypass valve 90 is in an open state, a flue gas is guided from the pipe L1 to the pipe L2 via the pipe L7. When the bypass valve 90 is in a closed state, no flue gas is guided to the pipe L7, and the whole amount of the flue gas flowing through the pipe L1 is guided to the pipe L2 via the ammonia decomposition unit 10.

When the supply amount of unburned ammonia contained in the flue gas from the combustion device 200 is larger than the amount of ammonia required to decompose nitrous oxide and NOx in the nitrogen oxide decomposition unit 20, the flue gas treatment device 100A of the present embodiment opens the bypass valve 90 to guide the whole amount of the flue gas flowing through the pipe L1 to the ammonia decomposition unit 10 and decomposes excessive ammonia in the ammonia decomposition unit 10.

In contrast, when the supply amount of unburned ammonia contained in the flue gas from the combustion device 200 is smaller than or equal to the amount of ammonia required to decompose nitrous oxide and NOx in the nitrogen oxide decomposition unit 20, the flue gas treatment device 100A of the present embodiment opens the bypass valve 90 to guide a part of the flue gas flowing through the pipe L1 to the pipe L2 without causing the flue gas to pass through the ammonia decomposition unit 10.

Figure 9:
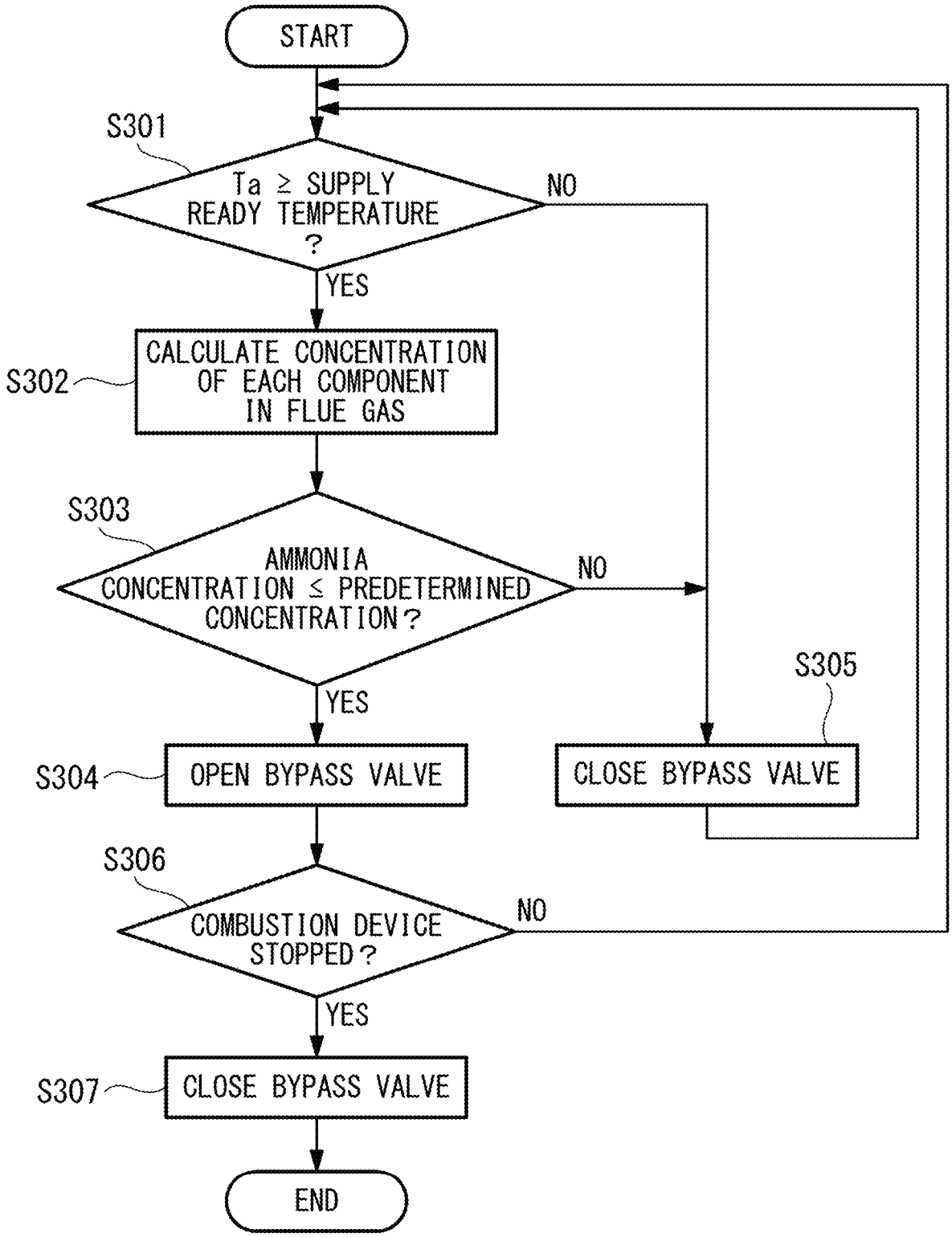
FIG. 9 is a flowchart illustrating a process of switching a bypass valve of the flue gas treatment device according to the second embodiment of the present disclosure.

Next, a process of switching the bypass valve 90 of the flue gas treatment device 100A according to the present embodiment will be described with reference to FIG. 9. FIG. 9 is a flowchart illustrating the process of switching the bypass valve 90 of the flue gas treatment device 100A according to the present embodiment. The process of each step of FIG. 9 is performed by the control unit 80 controlling each unit of the flue gas treatment device 100A. In response to start of a combustion operation by the combustion device 200, the process of the present flowchart is started.

In step S301, the control unit 80 determines whether or not the temperature Ta of a flue gas flowing through the pipe L2 transmitted from the temperature sensor 60 is higher than or equal to a supply ready temperature (for example, 350° C.) at which a reducing agent is ready to be supplied to the nitrogen oxide decomposition unit 20. If the determination is YES, the control unit 80 proceeds with the process to step S302, and if the determination is NO, the control unit 80 proceeds with the process to step S305.

In step S302, based on the load of the combustion device 200, the control unit 80 calculates the concentration of each component of ammonia, nitrous oxide, and NOx in the flue gas from the combustion device 200. The combustion device 200 transmits the load of the combustion operation to the control unit 80. The control unit 80 stores in advance a map of the concentration of each component of ammonia, nitrous oxide, and NOx in association with a plurality of loads of the combustion device 200, respectively, in a storage unit (not illustrated). The control unit 80 calculates the concentration in association with a load transmitted from the combustion device 200 with reference to the map stored in the storage unit.

In step S303, the control unit 80 determines whether or not the ammonia concentration calculated in step S302 is lower than or equal to a predetermined concentration. If the determination is YES, the control unit 80 proceeds with the process to step S304, and if the determination is NO, the control unit 80 proceeds with the process to step S305. Herein, the predetermined concentration is a concentration expressed by the following formula (12).

$$\alpha \times \text{nitrous oxide concentration} + \beta \times NOx \text{ concentration} \quad (12)$$

Herein, α and β are coefficients, for example, α=1.0, which are the same as those described with formula (11) in the first embodiment.

In step S304, since the ammonia concentration is lower than or equal to the predetermined concentration, and it is not necessary to supply the whole amount of the flue gas to the ammonia decomposition unit 10 in order to decompose excessive ammonia by the ammonia decomposition unit 10, the control unit 80 opens the bypass valve 90.

In step S305, since the temperature Ta of the flue gas is lower than the supply ready temperature at which the reducing agent is ready to be supplied to the nitrogen oxide decomposition unit 20 or the ammonia concentration is higher than the predetermined concentration, the control unit 80 closes the bypass valve 90. This is because the temperature of the flue gas from the combustion device 200 is not sufficiently high or the ammonia concentration contained in the flue gas is higher than the predetermined concentration and it is thus necessary to supply the whole amount of the flue gas to the ammonia decomposition unit 10.

In step S306, the control unit 80 determines whether or not the combustion device 200 is stopped. If the determination is YES, the control unit 80 proceeds with the process to step S307, and if the determination is NO, the control unit 80 performs step S301 again. The combustion device 200 transmits the operation state including the combustion operation stop state to the control unit 80.

In step S307, since the combustion device 200 is stopped, the control unit 80 closes the bypass valve 90 and ends the process of the present flowchart. In response to the combustion device 200 starting a combustion operation, the control unit 80 restarts the process of the present flowchart.

The effects and advantages achieved by the flue gas treatment device 100A of the present embodiment described above will be described.

According to the flue gas treatment device 100A of the present embodiment, when the concentration of ammonia contained in the flue gas from the combustion device 200 is higher than the concentration required as the reducing agent when nitrous oxide and NOx are decomposed in the nitrogen oxide decomposition unit 20, the bypass valve 90 is closed, and thereby excessive ammonia can be decomposed in the ammonia decomposition unit 10. Further, when the concentration of ammonia contained in the flue gas from the combustion device 200 is lower than or equal to the concentration required as the reducing agent when nitrous oxide and NOx are decomposed in the nitrogen oxide decomposition unit 20, the bypass valve 90 is opened, and thereby ammonia can be guided to the nitrogen oxide decomposition unit 20 without being decomposed in the ammonia decomposition unit 10.

Third Embodiment

A flue gas treatment device 100B of a third embodiment of the present disclosure will be described below with reference to the drawings. The flue gas treatment device 100B of the present embodiment is a modified example for the flue gas treatment device 100 of the first embodiment and, except as specifically described below, is the same as that of the first embodiment, and the description thereof will be omitted below.

In the flue gas treatment device 100 of the first embodiment, the ammonia decomposition unit 10 is arranged upstream of the nitrogen oxide decomposition unit 20. In contrast, in the flue gas treatment device 100B of the present embodiment, the ammonia decomposition unit 10 is not arranged upstream of the nitrogen oxide decomposition unit 20.

Figure 10:
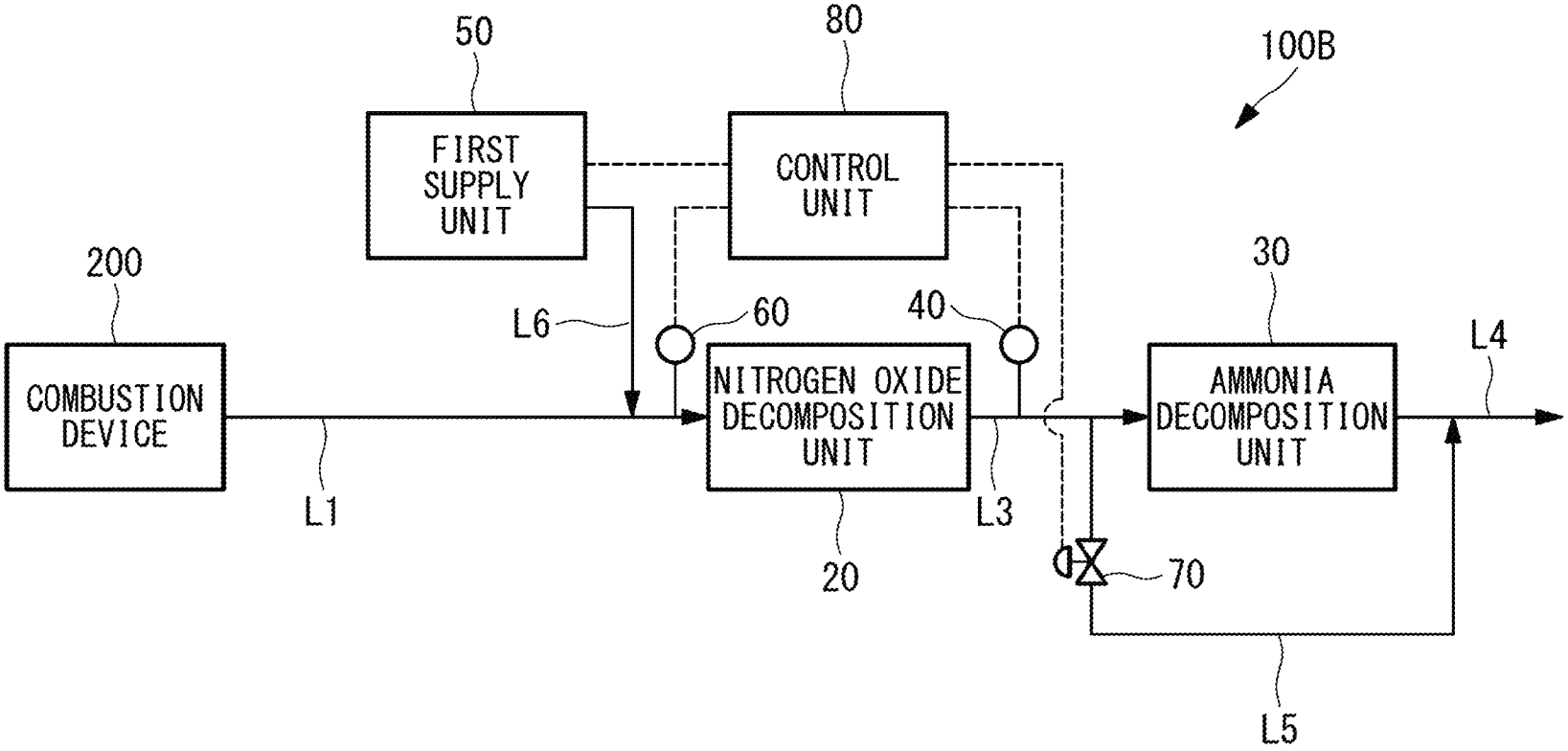
FIG. 10 is a schematic configuration diagram illustrating a flue gas treatment device according to a third embodiment of the present disclosure.

FIG. 10 is a schematic configuration diagram illustrating the flue gas treatment device 100B according to the third embodiment of the present disclosure. As illustrated in FIG. 10, in the flue gas treatment device 100B of the present embodiment, the ammonia decomposition unit 10 is not arranged upstream of the nitrogen oxide decomposition unit 20, and the flue gas from the combustion device 200 is supplied to the nitrogen oxide decomposition unit 20 via the pipe L1.

In the present embodiment, the reason why the ammonia decomposition unit 10 is not installed upstream of the nitrogen oxide decomposition unit 20 is that the supply amount of unburned ammonia contained in the flue gas from the combustion device 200 is assumed to be smaller than or equal to the amount of ammonia required to decompose nitrous oxide and NOx in the nitrogen oxide decomposition unit 20. The flue gas treatment device 100B of the present embodiment compensates for shortage of ammonia required as the reducing agent to decompose nitrous oxide and NOx contained in the flue gas by supplying the required ammonia from the first supply unit 50.

The flue gas treatment device 100B of the present embodiment assumes that the concentrations of ammonia, nitrous oxide, and NOx contained in the flue gas from the combustion device 200 satisfy the following formula (13), respectively.

$$\text{anmonia concentration} \leq \alpha \times \text{nitrous oxide concentration} + \beta \times NOx \text{ concentration} \quad (13)$$

Herein, α and β are coefficients, which are the same as those described with formula (11) in the first embodiment.

The process of supplying a reducing agent in the flue gas treatment device 100B of the present embodiment is the same as the process illustrated in FIG. 6 of the first embodiment. Further, the process of switching the bypass valve 70 in the flue gas treatment device 100B of the present embodiment is the same as the process illustrated in FIG. 7 of the first embodiment.

The effects and advantages achieved by the flue gas treatment device 100B of the present embodiment described above will be described.

According to the flue gas treatment device 100B of the present embodiment, ammonia contained in a flue gas from the combustion device 200 reacts with nitrous oxide and NOx as a reducing agent and is decomposed by a nitrogen oxide decomposition catalyst when passing through the nitrogen oxide decomposition unit 20. Further, nitrous oxide and NOx produced when ammonia is combusted in the combustion device 200 are suitably decomposed by the nitrogen oxide decomposition catalyst when passing through the nitrogen oxide decomposition unit 20. As described above, according to the flue gas treatment device 100B of the present embodiment, ammonia, nitrous oxide, and NOx contained in a flue gas from the combustion device 200 that combusts fuel containing ammonia can be suitably decomposed.

Fourth Embodiment

A design method of a flue gas treatment device according to a fourth embodiment of the present disclosure will be described below. The design method of the present embodiment is a method for determining whether to employ the design of arranging the ammonia decomposition unit 10 upstream of the nitrogen oxide decomposition unit 20 as with the flue gas treatment devices 100, 100A described in the first embodiment and the second embodiment or to employ the design of not arranging the ammonia decomposition unit 10 upstream of the nitrogen oxide decomposition unit 20 as with the flue gas treatment devices 100B described in the third embodiment.

Figure 11:
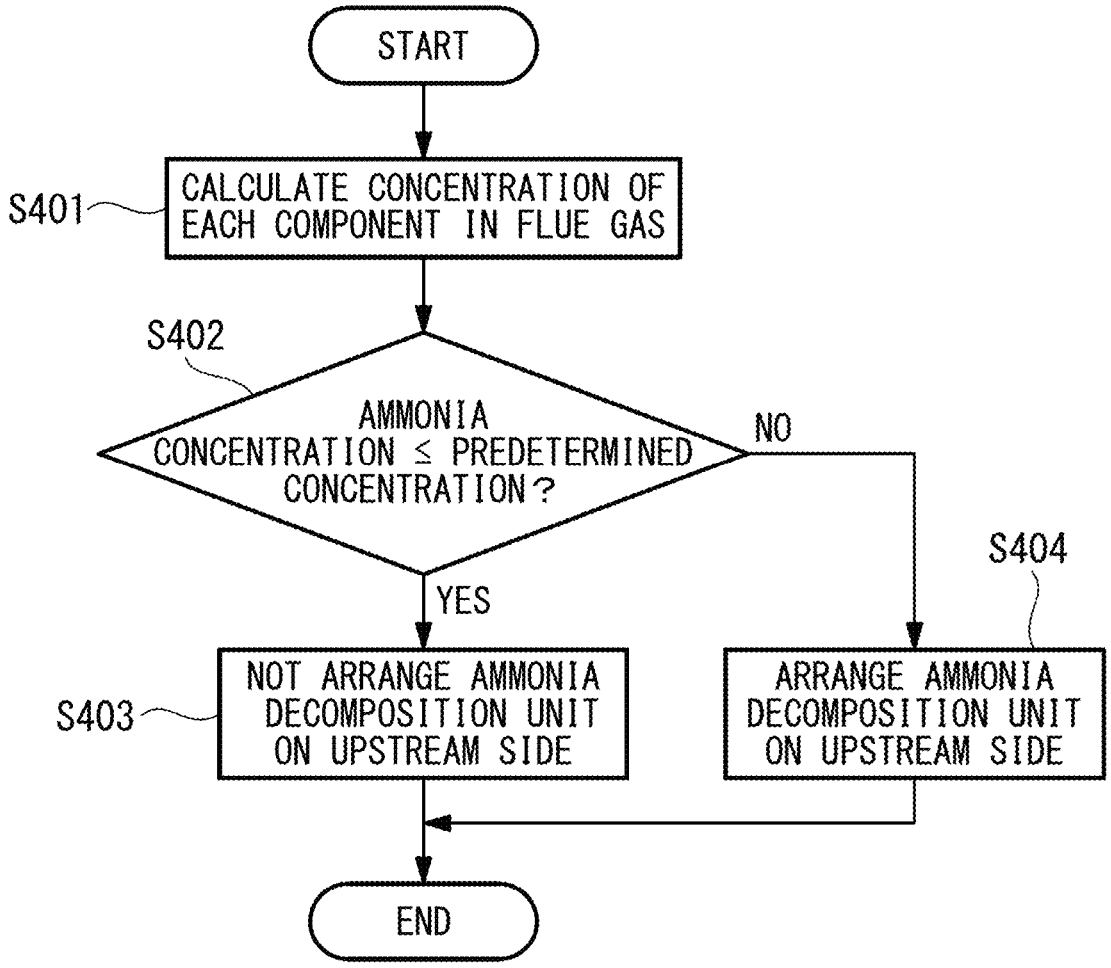
FIG. 11 is flowchart illustrating a design method of a flue gas treatment device according to a fourth embodiment of the present disclosure.

FIG. 11 is flowchart illustrating a design method of a flue gas treatment device according to the present embodiment.

In step S401, concentrations of respective components of ammonia, nitrous oxide, and NOx in a flue gas from the combustion device 200 are calculated. Under the assumption that the combustion device 200 is operated at a predefined constant load, the concentrations of respective components of ammonia, nitrous oxide, and NOx in the flue gas at the load are determined.

In step S402, it is determined whether or not the ammonia concentration calculated in step S401 is lower than or equal to a predetermined concentration. If the determination is YES, the process proceeds to step S404, and if the determination is NO, the process proceeds to step S404. Herein, the predetermined concentration is the concentration expressed by formula (12) of the second embodiment, which is α×nitrous oxide concentration+β×NOx concentration.

In step S403, since the ammonia concentration in the flue gas from the combustion device 200 is lower than or equal to the predetermined concentration, the design of the flue gas treatment device 100B of the third embodiment is employed that does not arrange the ammonia decomposition unit 10 upstream of the nitrogen oxide decomposition unit 20. Such design is employed because it is not necessary to decompose excessive ammonia by arranging the ammonia decomposition unit 10 upstream of the nitrogen oxide decomposition unit 20.

In step S404, since the ammonia concentration in the flue gas from the combustion device 200 is higher than the predetermined concentration, the design of the flue gas treatment device 100 of the first embodiment or the flue gas treatment device 100A of the second embodiment is employed that arranges the ammonia decomposition unit 10 upstream of the nitrogen oxide decomposition unit 20. Such design is employed because the concentration of ammonia contained in the flue gas is higher than the predetermined concentration and it is thus necessary to decompose excessive ammonia by supplying the whole amount of the flue gas to the ammonia decomposition unit 10.

According to the design method of the flue gas treatment device of the present embodiment, a flue gas treatment device is designed such that, when the concentration of ammonia contained in the flue gas is higher than the sum concentration of a first concentration, which is obtained by multiplying the concentration of nitrous oxide contained in the flue gas by a (first coefficient), and a second concentration, which is obtained by multiplying the concentration of NOx contained in the flue gas by β (second coefficient), the ammonia decomposition unit 10 is arranged downstream of the combustion device 200, and the nitrogen oxide decomposition unit 20 is arranged downstream of the ammonia decomposition unit 10 in order to prevent the concentration of ammonia supplied from the ammonia decomposition unit 10 to the nitrogen oxide decomposition unit 20 from being excessively high.

In contrast, when the concentration of ammonia contained in the flue gas is lower than or equal to the sum concentration of the first concentration, which is obtained by multiplying the concentration of nitrous oxide contained in the flue gas by a (first coefficient), and the second concentration, which is obtained by multiplying the concentration of NOx contained in the flue gas by β (second coefficient), the concentration of ammonia supplied from the ammonia decomposition unit 10 to the nitrogen oxide decomposition unit 20 is not excessively high. Thus, the flue gas treatment device is designed so that the nitrogen oxide decomposition unit 20 is arranged without the ammonia decomposition unit 10 being arranged downstream of the combustion device 200. Accordingly, it is possible to design a flue gas treatment device having a suitable configuration in accordance with a concentration of ammonia contained in a flue gas from the combustion device 200.

Fifth Embodiment

Next, a flue gas treatment device 100C of a fifth embodiment of the present disclosure will be described with reference to the drawings. The flue gas treatment device 100C of the present embodiment is a modified example for the flue gas treatment device 100 of the first embodiment and, except as specifically described below, is the same as that of the first embodiment, and the description thereof will be omitted below.

The flue gas treatment device 100C of the present embodiment differs from the flue gas treatment device 100 of the first embodiment in that the flue gas treatment device 100C includes a second supply unit 55 that supplies ammonia or urea water as fuel, which is used for heating an ammonia decomposition catalyst (first treatment unit) of the ammonia decomposition unit 10, into the flue gas supplied from the combustion device 200 to the ammonia decomposition unit 10. Further, the flue gas treatment device 100C of the present embodiment differs from the flue gas treatment device 100 of the first embodiment in that the flue gas treatment device 100C does not have the ammonia decomposition unit 30.

Figure 12:
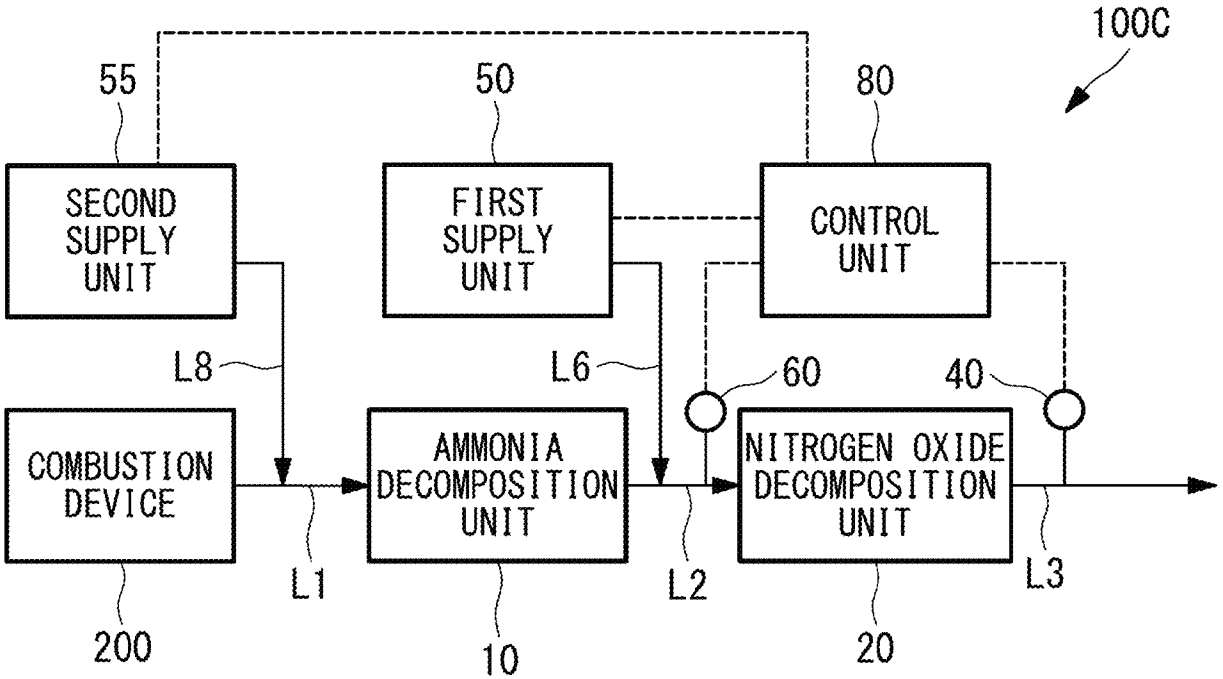
FIG. 12 is a schematic configuration diagram illustrating a flue gas treatment device according to a fifth embodiment of the present disclosure.

FIG. 12 is a schematic configuration diagram illustrating the flue gas treatment device 100C according to the present embodiment. As illustrated in FIG. 12, the flue gas treatment device 100C of the present embodiment includes the ammonia decomposition unit (first treatment unit) 10, the nitrogen oxide decomposition unit (second treatment unit) 20, the detection unit 40, the first supply unit 50, the second supply unit 55, the temperature sensor 60, and the control unit 80. Since the configurations other than the second supply unit 55 are the same as those of the first embodiment, the description thereof will be omitted below.

The second supply unit 55 is a device that supplies ammonia or urea water as fuel, which is used for heating the ammonia decomposition catalyst, into the flue gas supplied from the combustion device 200 to the ammonia decomposition unit 10 when the temperature determined by the temperature sensor 60 is lower than or equal to a predetermined temperature. The second supply unit 55 supplies urea water to the pipe L1 via the pipe L8 and produces ammonia due to a hydrolysis reaction with the urea water.

Ammonia guided to the ammonia decomposition unit 10 is decomposed by the effect of the ammonia decomposition catalyst in accordance with the reactions of formulae (1), (2) of the first embodiment. The flue gas passing through the ammonia decomposition unit 10 is heated by an exothermic reaction occurring when ammonia is decomposed. Further, instead of supplying urea water from the second supply unit 55, ammonia may be supplied from the second supply unit 55 to the pipe L2.

The inventors have examined the relationship between the property of a flue gas from the combustion device 200 and the decomposition rate of nitrous oxide through experiments and obtained knowledge that there is a temperature range in which the decomposition rate of nitrous oxide varies with the concentration of NO contained in the flue gas. If the decomposition rate of nitrous oxide varies with the concentration of NO contained in the flue gas, this may cause inability to obtain a desired decomposition rate of nitrous oxide with the flue gas treatment device 100 of the first embodiment. Accordingly, the flue gas treatment device 100C of the present embodiment is configured to operate the nitrogen oxide decomposition unit 20 within a temperature range that does not cause a change in the decomposition rate of nitrous oxide due to the concentration of NO contained in the flue gas.

Figure 13:
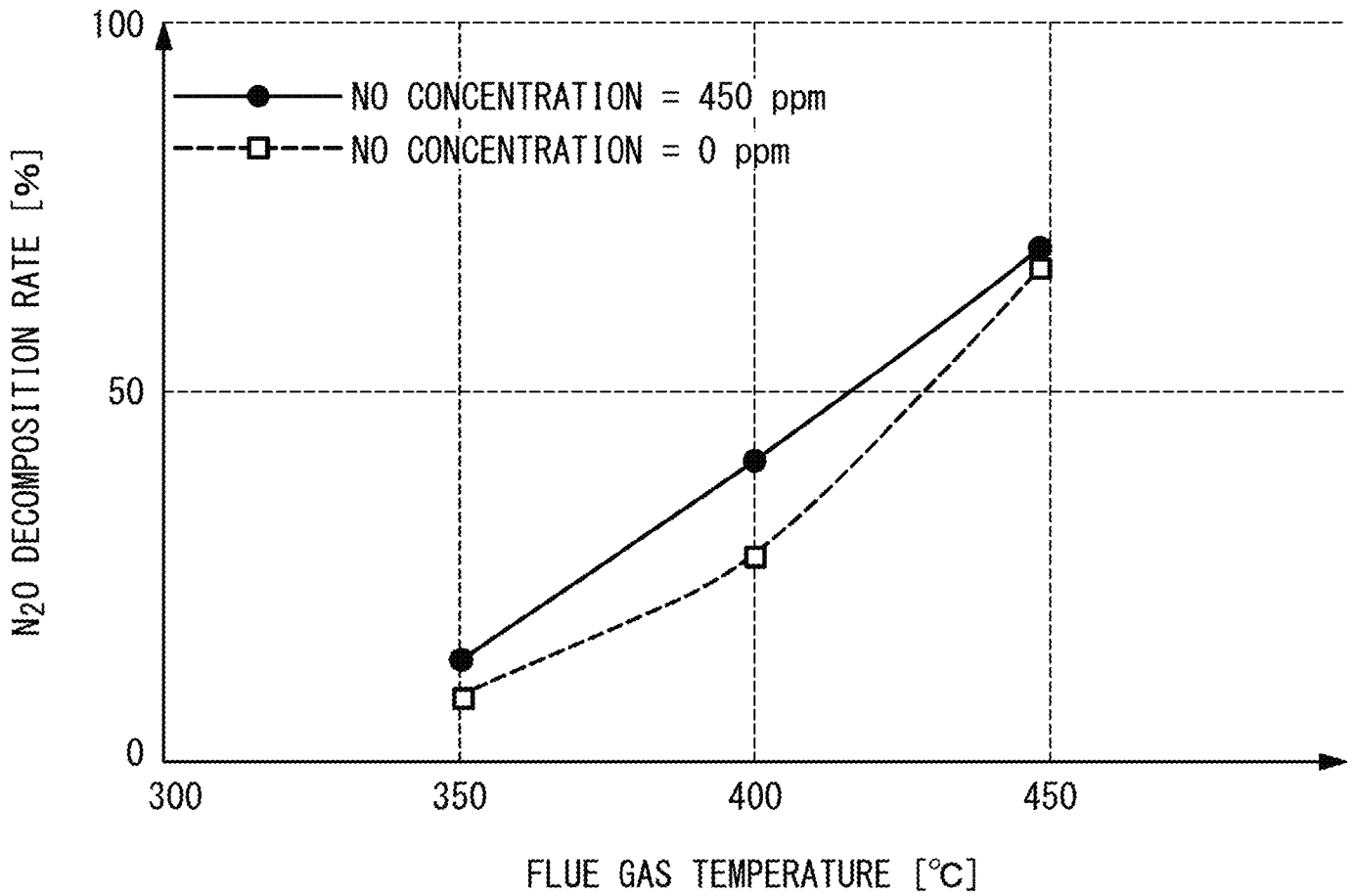
FIG. 13 is a graph illustrating a decomposition rate of nitrous oxide with respect to the temperature of a flue gas in a nitrogen oxide decomposition unit, which is a graph about comparison between a case where the NO concentration is 0 ppm and a case where the NO concentration is 450 ppm.

FIG. 13 illustrates the decomposition rate of nitrous oxide with respect to the temperature of a flue gas in the nitrogen oxide decomposition unit 20, which is a graph about comparison between a case where the NO concentration is 0 ppm and a case where the NO concentration is 450 ppm. FIG. 13 illustrates an example using the catalyst A as the nitrogen oxide decomposition catalyst of the nitrogen oxide decomposition unit 20. The example indicated by a solid line and the example indicated by a dotted line in FIG. 13 differ from each other in that the NO concentrations in the flue gas are 450 ppm and 0 ppm. On the other hand, the example indicated by the solid line and the example indicated by the dotted line in FIG. 13 are common to each other in that the nitrous oxide concentration in the flue gas is 180 ppm, the ammonia concentration in the flue gas is 570 ppm, the oxygen concentration in the flue gas is 13%, the sulfur dioxide concentration in the flue gas is 15 ppm, the moisture concentration in the flue gas is 15%, and the remainder is nitrogen.

As illustrated in FIG. 13, as long as the temperature of the flue gas is around 450° C., there is almost no difference in the decomposition rate of nitrous oxide even when the NO concentration in the flue gas differs between 450 ppm and 0 ppm. In contrast, as the temperature of the flue gas decreases below 450° C., the difference in the decomposition rate of nitrous oxide increases. Specifically, for the same flue gas temperature, the decomposition rate of nitrous oxide when the NO concentration in the flue gas is 0 ppm is lower than the decomposition rate of nitrous oxide when the NO concentration in the flue gas is 450 ppm.

It is assumed that FIG. 13 exhibits the above tendency because, in the temperature range lower than 450° C., oxygen bound to the nitrogen oxide decomposition catalyst in the following formula (11) is removed, oxygen bound in the following formula (12) is removed, and/or nitrous oxide is reduced by the reaction of the following formula (13). That is, it is assumed that the above tendency is caused because the decomposition rate of nitrous oxide is higher when NO in the flue gas is present together with nitrous oxide.

$$2N_2O \longrightarrow 2N_2 + 3O_2 \tag{11}$$

$$4NO + 4NH_3 + O_2 \longrightarrow 4N_2 + 6H_2O \tag{12}$$

$$N_2O + NO \longrightarrow N_2 + NO_2 \tag{13}$$

The inventors have taken the above experiment result indicated in FIG. 13 into account and set the temperature range so that the temperature of the flue gas from the ammonia decomposition unit 10 is higher than or equal to 450° C. so as not to cause a change in the decomposition rate of nitrous oxide due to the concentration of NO contained in the flue gas. Further, the inventors have set the temperature range so that the temperature of the flue gas from the ammonia decomposition unit 10 is lower than or equal to 530° C. in order to reduce thermal stress on the catalyst reactor and suppress thermal deterioration of the catalyst.

Figure 14:
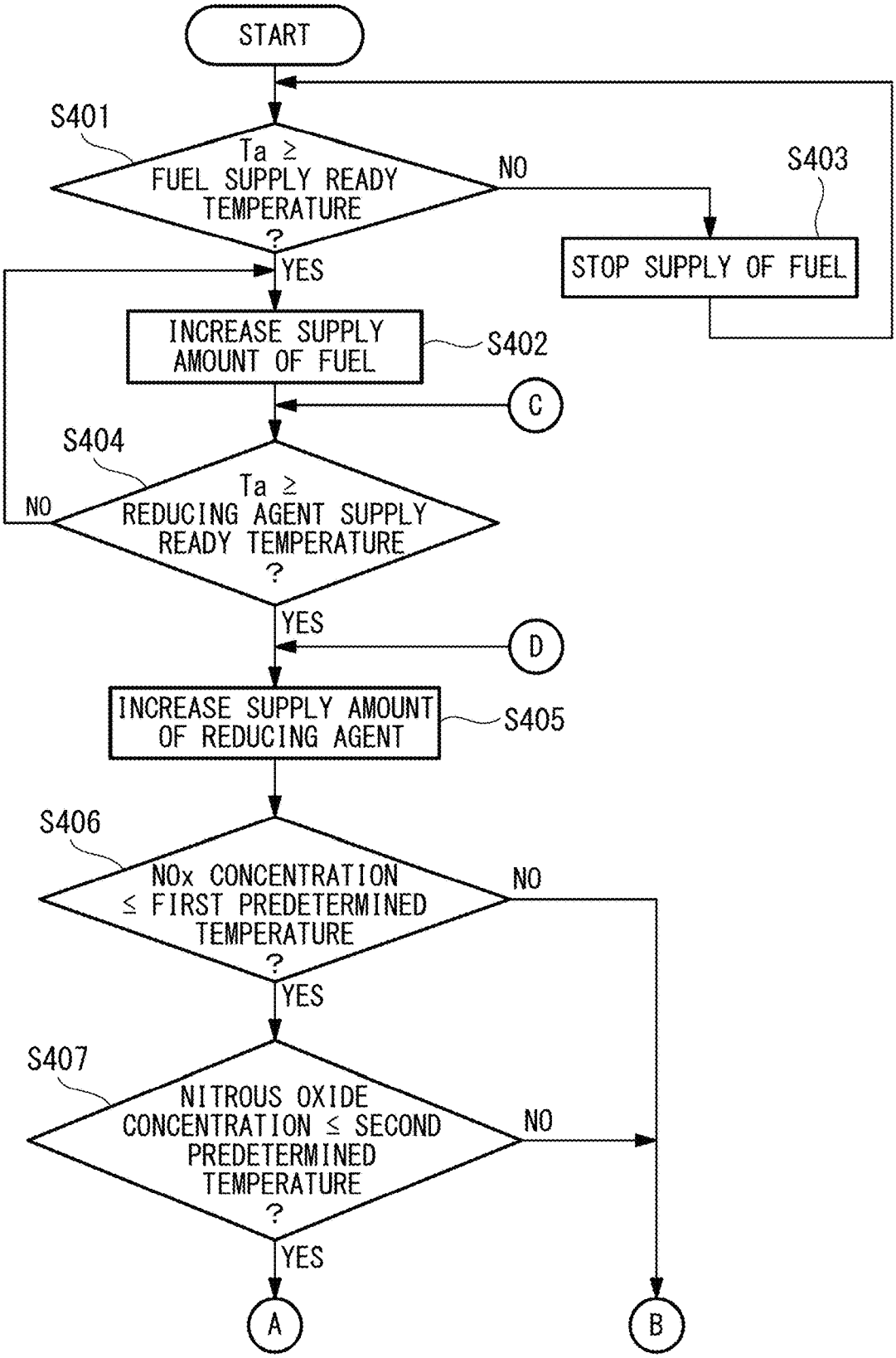
FIG. 14 is a flowchart illustrating a process of supplying fuel and a reducing agent in the flue gas treatment device according to the fifth embodiment of the present disclosure.
Figure 15:
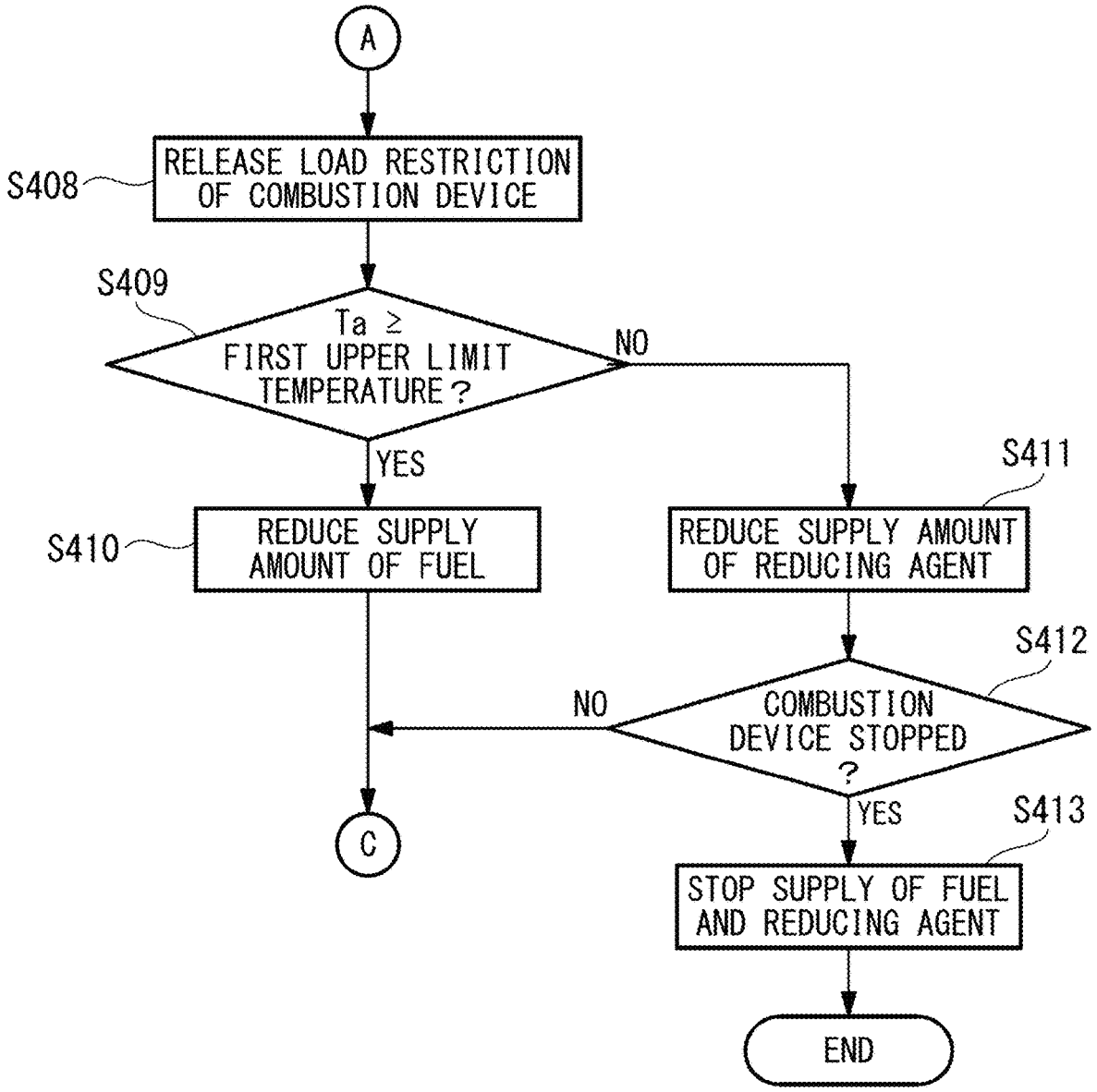
FIG. 15 is a flowchart illustrating the process of supplying fuel and a reducing agent in the flue gas treatment device according to the fifth embodiment of the present disclosure.
Figure 16:
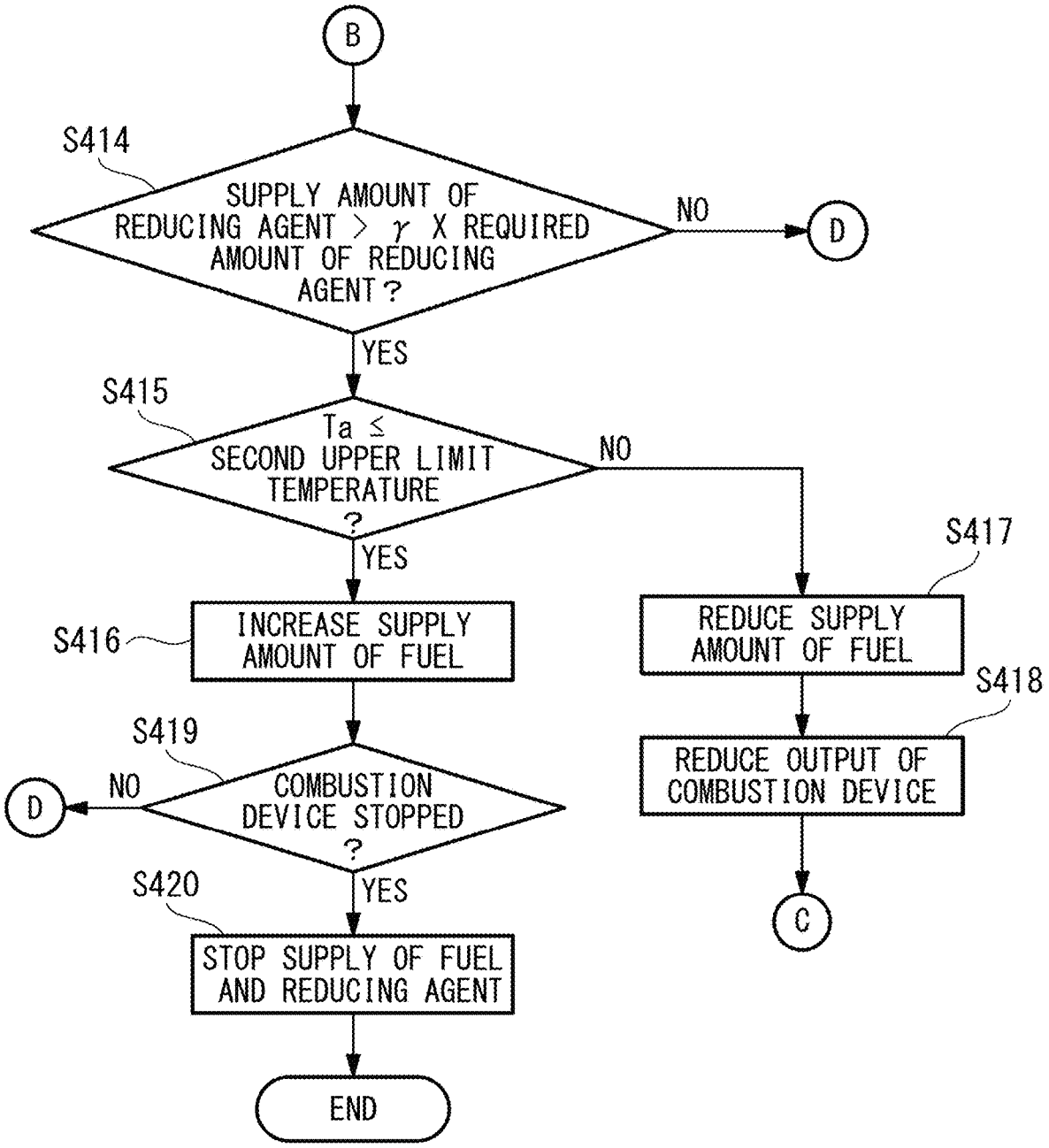
FIG. 16 is a flowchart illustrating the process of supplying fuel and a reducing agent in the flue gas treatment device according to the fifth embodiment of the present disclosure.

Next, a process of supplying fuel and a reducing agent in the flue gas treatment device 100C according to the present embodiment will be described with reference to FIG. 14 to FIG. 16. FIG. 14 to FIG. 16 are flowcharts illustrating the process of supplying fuel and a reducing agent in the flue gas treatment device 100C according to the present embodiment. The process of each step of FIG. 14 to FIG. 16 is performed by the control unit 80 controlling each unit of the flue gas treatment device 100C. In response to start of a combustion operation by the combustion device 200, the process of the present flowchart is started.

In step S401, the control unit 80 determines whether or not the temperature Ta of a flue gas flowing through the pipe L2 transmitted from the temperature sensor 60 is higher than or equal to a fuel supply ready temperature (for example, 300° C.) at which fuel used for heating the ammonia decomposition catalyst (first treatment unit) is ready to be supplied from the second supply unit 55 to the ammonia decomposition unit 10. If the determination is YES, the control unit 80 proceeds with the process to step S402, and if the determination is NO, the control unit 80 proceeds with the process to step S403.

In step S402, the control unit 80 controls the second supply unit 55 to increase the supply amount of fuel from the second supply unit 55 to the pipe L1. When step S402 is performed for the first time after step S401, the supply amount of the fuel from the second supply unit 55 is increased from 0 to a predetermined supply amount.

In step S403, since the temperature Ta of the flue gas flowing through the pipe L1 is lower than the fuel supply ready temperature at which the fuel is ready to be supplied to the ammonia decomposition unit 10, the control unit 80 performs control to stop supply of the fuel from the second supply unit 55.

In step S404, the control unit 80 determines whether or not the temperature Ta of the flue gas is higher than or equal to a reducing agent supply ready temperature (for example, 450° C.) at which a reducing agent is ready to be supplied to the nitrogen oxide decomposition unit 20. If the determination is YES, the control unit 80 proceeds with the process to step S405, and if the determination is NO, the control unit 80 proceeds with the process to step S402 to increase the supply amount of fuel from the second supply unit 55.

In step S405, the control unit 80 controls the first supply unit 50 to increase the supply amount of the reducing agent from the first supply unit 50 to the pipe L2. When step S405 is performed for the first time after step S404, the supply amount of the reducing agent from the first supply unit 50 is increased from 0 to a predetermined supply amount.

In step S406, the control unit 80 determines whether or not the NOx concentration determined by the detection unit 40 is lower than or equal to a first predetermined concentration (for example, 200 ppm). If the determination is YES, the control unit 80 proceeds with the process to step S407, and if the determination is NO, the control unit 80 proceeds with the process to step S414.

In step S407, the control unit 80 determines whether or not the nitrous oxide concentration determined by the detection unit 40 is lower than or equal to a second predetermined concentration (for example, 10 ppm). If the determination is YES, the control unit 80 proceeds with the process to step S408, and if the determination is NO, the control unit 80 proceeds with the process to step S414.

In step S408, the control unit 80 controls the combustion device 200 to release the load restriction on the combustion device 200. The control unit 80 controls the combustion device 200 to be operated at a load less than or equal to a predetermined load until the load restriction is released in the present step. This is because, when the combustion device 200 is operated without the restriction being provided to the load thereof, if the supply amount of the reducing agent supplied from the first supply unit 50 to the nitrogen oxide decomposition unit 20 is excessive for reducing the NOx concentration and the nitrous oxide concentration, unreacted ammonia may be exhausted externally from the nitrogen oxide decomposition unit 20 via the pipe L3.

By controlling the combustion device 200 to be less than or equal to a predetermined load until the load restriction is released by the present step, it is possible to prevent unreacted ammonia from being exhausted externally from the nitrogen oxide decomposition unit 20 via the pipe L3 and maintain the NOx concentration and nitrous oxide concentration below a threshold, which can reduce the environmental load.

In step S409, the control unit 80 determines whether or not the temperature Ta is lower than or equal to a first upper limit temperature (for example, 480° C.). If the determination is YES, the control unit 80 proceeds with the process to step S410, and if the determination is NO, the control unit 80 proceeds with the process to step S411.

In step S410, the control unit 80 reduces the supply amount of the fuel from the second supply unit 55 to the pipe L1 so that the temperature Ta becomes lower than the first upper limit temperature. The control unit 80 proceeds with the process to step S404 after performing step S410.

In step S411, since the temperature Ta is lower than the first upper limit temperature, the control unit 80 reduces the supply amount of the reducing agent from the first supply unit 50 to the pipe L2 and proceeds with the process to step S412.

In step S412, the control unit 80 determines whether or not the combustion device 200 is stopped. If the determination is YES, the control unit 80 proceeds with the process to step S413, and if the determination is NO, the control unit 80 performs step S404 again. The combustion device 200 transmits the operation state including the combustion operation stop state to the control unit 80.

In step S413, since the combustion device 200 is stopped, the control unit 80 stops supply of the reducing agent from the first supply unit 50 and supply of the fuel from the second supply unit 55 and ends the process of the present flowchart. In response to the combustion device 200 starting a combustion operation, the control unit 80 restarts the process of the present flowchart.

In step S414, the control unit 80 calculates the amount of the reducing agent required for reducing NOx and nitrous oxide with respect to the NOx concentration and the nitrous oxide concentration calculated in step S302 of FIG. 9 and determines whether or not the amount of the reducing agent being supplied is larger than an amount obtained by multiplying the required amount of the reducing agent by a predetermined coefficient γ. If the determination is YES, the control unit 80 proceeds with the process to step S415, and if the determination is NO, the control unit 80 proceeds with the process to step S405. Herein, the predetermined amount of reducing agent supply is a supply amount obtained by multiplying an amount of the reducing agent required for reducing NOx and nitrous oxide included in the sum concentration of nitrogen oxide by the predetermined coefficient 7. The coefficient γ is set to, for example, a value that is greater than or equal to 0.8 and less than or equal to 1.2.

In step S415, the control unit 80 determines whether or not the temperature Ta is lower than or equal to a second upper limit temperature (for example, 530° C.). If the determination is YES, the control unit 80 proceeds with the process to step S416, and if the determination is NO, the control unit 80 proceeds with the process to step S417.

In step S416, the control unit 80 increases the supply amount of the fuel from the second supply unit 55 to the pipe L1. The control unit 80 proceeds with the process to step S419 after performing step S416.

In step S417, the control unit 80 reduces the supply amount of the fuel from the second supply unit 55 to the pipe L1 so that the temperature Ta becomes lower than the second upper limit temperature.

In step S418, the control unit 80 reduces the output of the combustion device 200 (for example, reduces the load by 10%) and proceeds with the process to step S404.

In step S419, the control unit 80 determines whether or not the combustion device 200 is stopped. If the determination is YES, the control unit 80 proceeds with the process to step S420, and if the determination is NO, the control unit 80 performs step S405 again. The combustion device 200 transmits the operation state including the combustion operation stop state to the control unit 80.

In step S420, since the combustion device 200 is stopped, the control unit 80 stops supply of the reducing agent from the first supply unit 50 and supply of the fuel from the second supply unit 55 and ends the process of the present flowchart. In response to the combustion device 200 starting a combustion operation, the control unit 80 restarts the process of the present flowchart.

Note that, although fuel is supplied from the second supply unit 55 to produce ammonia used for causing an exothermic reaction with the ammonia decomposition catalyst of the ammonia decomposition unit 10 in the above description, other forms may be employed. For example, ammonia or urea water may be supplied from the first supply unit 50 to the pipe L1.

According to the flue gas treatment device 100C of the present embodiment, ammonia or urea water is supplied into a flue gas supplied from the combustion device 200 to the ammonia decomposition unit 10, and thereby an exothermic reaction due to oxidization of ammonia in the ammonia decomposition unit 10 can be promoted. Accordingly, the temperature of the flue gas guided from the ammonia decomposition unit 10 to the nitrogen oxide decomposition unit 20 can be suitably increased to operate the nitrogen oxide decomposition unit 20 within a temperature range that does not cause a change in the decomposition rate of nitrous oxide due to the concentration of NO contained in the flue gas.

Further, according to the flue gas treatment device 100C of the present embodiment, the predetermined temperature is higher than or equal to 450° C. and lower than or equal to 530° C., and thereby the nitrogen oxide decomposition unit 20 can be operated within a suitable temperature range that does not cause a change in the decomposition rate of nitrous oxide due to the concentration of NO contained in the flue gas.

Note that, although the flue gas treatment device 100C of the present embodiment discharges the flue gas that has passed through the nitrogen oxide decomposition unit 20 externally via the pipe L3, other forms may be employed. For example, as with a flue gas treatment device 100D of a modified example illustrated in FIG. 17, the flue gas that has passed through the nitrogen oxide decomposition unit 20 may be introduced to the ammonia decomposition unit 30, and the flue gas that has passed through the ammonia decomposition unit 30 may be exhausted externally via the pipe L4.

Figure 17:
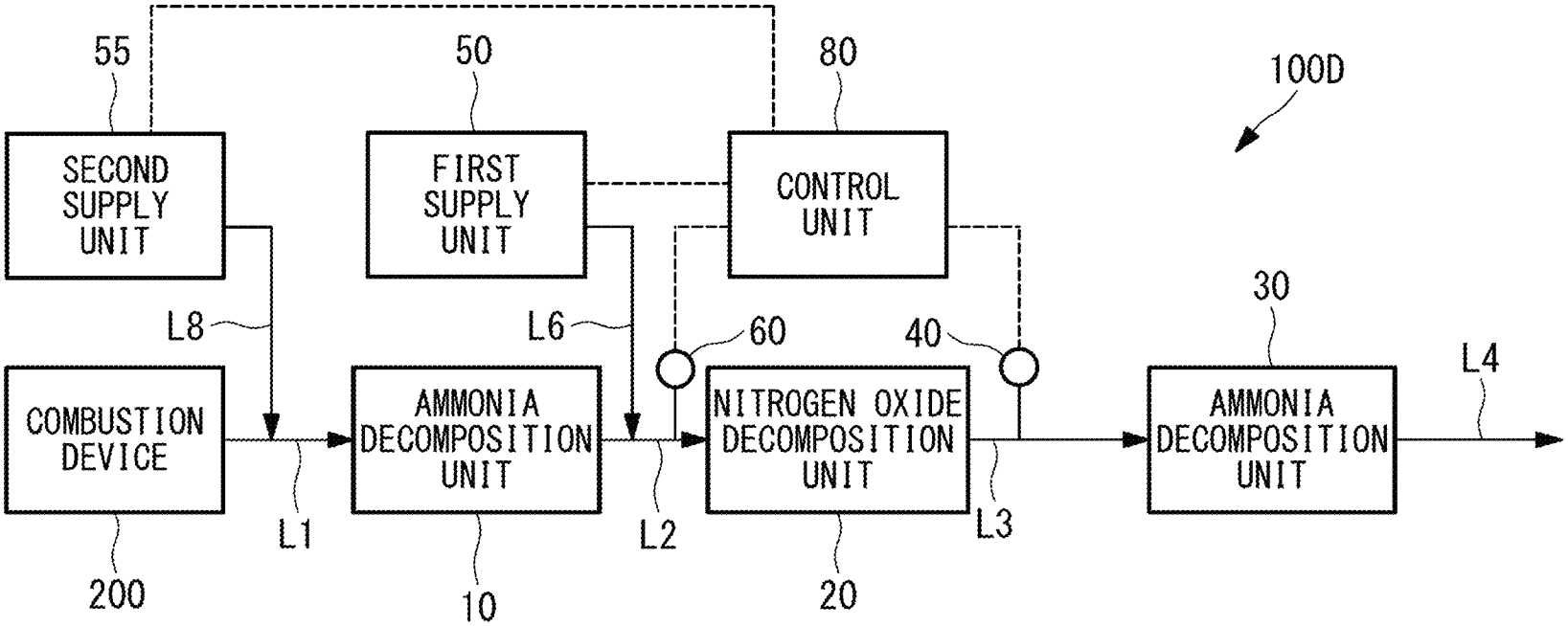
FIG. 17 is a schematic configuration diagram illustrating a flue gas treatment device according to a modified example for the fifth embodiment of the present disclosure.

FIG. 17 is a schematic configuration diagram illustrating the flue gas treatment device 100D according to a modified example for the fifth embodiment of the present disclosure. The ammonia decomposition unit 30 illustrated in FIG. 17 has the same configuration as the ammonia decomposition unit 30 of the first embodiment. According to the flue gas treatment device 100D illustrated in FIG. 17, even when ammonia is contained in the flue gas that has passed through the nitrogen oxide decomposition unit 20, ammonia can be suitably decomposed in the ammonia decomposition unit 30 to prevent ammonia from being exhausted externally.

Further, in the flue gas treatment device 100D illustrated in FIG. 17, since ammonia is suitably decomposed in the ammonia decomposition unit 30, there is no need for the load restriction of the combustion device 200 before step S408 of FIG. 15, or the frequency of the load restriction can be reduced. To eliminate the need for the load restriction or reduce the frequency of the load restriction, in step S414, an amount of the reducing agent required for reducing NOx and nitrous oxide is calculated with respect to the NOx concentration and the nitrous oxide concentration calculated in step S302 of FIG. 9, and the coefficient γ multiplied by the required amount of the reducing agent is set to a value larger than that in the fifth embodiment (for example, 1.5).

The flue gas treatment device and the design method of a flue gas treatment device according to each embodiment described above are understood as follows, for example.

A flue gas treatment device (100) according to the present disclosure is a flue gas treatment device (100, 100A) configured to treat a flue gas from a combustion device (200) that combusts fuel containing ammonia, and the flue gas treatment device includes: a first treatment unit (10) having a first catalyst that decomposes ammonia contained in the flue gas; and a second treatment unit (20) having a second catalyst that decomposes nitrous oxide and NOx contained in the flue gas in which ammonia was decomposed by the first treatment unit.

According to the flue gas treatment device of the present disclosure, ammonia contained in a flue gas from the combustion device is suitably decomposed by the first catalyst when passing through the first treatment unit. Further, nitrous oxide and NOx produced when ammonia is combusted in the combustion device are suitably decomposed by the second catalyst when passing through the second treatment unit. In such a way, according to the flue gas treatment device of the present disclosure, ammonia, nitrous oxide, and NOx contained in a flue gas from the combustion device that combusts fuel containing ammonia can be suitably decomposed.

The flue gas treatment device according to the present disclosure may be configured such that the first treatment unit removes, by the first catalyst, NOx produced when ammonia contained in the flue gas is decomposed.

According to the flue gas treatment device of the present configuration, since NOx produced when ammonia is decomposed by the first treatment unit is removed by the first catalyst, NOx contained in the flue gas from the combustion device can be suitably prevented from increasing when passing through the first treatment unit.

The flue gas treatment device according to the present disclosure may be configured to include: a bypass pipe (L7) configured to guide, to the second treatment unit, the flue gas from the combustion device without causing the flue gas to pass through the first treatment unit; and a bypass valve (90) arranged on the bypass pipe.

According to the flue gas treatment device of the present configuration, when the concentration of ammonia contained in the flue gas from the combustion device is higher than the concentration required as a reducing agent when nitrous oxide and NOx are decomposed in the second treatment unit, the bypass valve is closed, and thereby excessive ammonia can be decomposed in the first treatment unit. Further, when the concentration of ammonia contained in the flue gas from the combustion device is lower than or equal to the concentration required as a reducing agent when nitrous oxide and NOx are decomposed in the second treatment unit, the bypass valve is opened, and thereby ammonia can be guided to the second treatment unit without being decomposed in the first treatment unit.

The flue gas treatment device according to the present disclosure may be configured to include a third treatment unit (30) configured to decompose ammonia contained in the flue gas that passed through the second treatment unit.

According to the flue gas treatment device of the present configuration, even when ammonia remains in the flue gas that has passed through the second treatment unit, ammonia is decomposed in the third treatment unit, and this can prevent ammonia from being exhausted externally.

The flue gas treatment device according to the present disclosure may be configured to include: a detection unit (40) configured to determine a concentration of nitrous oxide and/or NOx contained in the flue gas that passed through the second treatment unit; and a first supply unit (50) configured to supply ammonia or urea water into the flue gas supplied from the first treatment unit to the second treatment unit when the concentration of nitrous oxide contained in the flue gas is higher than a first predetermined concentration or the concentration of NOx contained in the flue gas is higher than a second predetermined concentration, and the second catalyst is a catalyst that reduces and decomposes nitrous oxide and NOx contained in the flue gas by ammonia.

According to the flue gas treatment device of the present configuration, when the detection unit determines that the concentration of nitrous oxide contained in the flue gas that has passed through the second treatment unit is higher than the first predetermined concentration or that the concentration of NOx contained in the flue gas that has passed through the second treatment unit is higher than the second predetermined concentration, ammonia or urea water is supplied as a reducing agent from the first supply unit into the flue gas supplied to the second treatment unit in order to compensate for shortage of ammonia used for reducing nitrous oxide and NOx. Thus, the shortage of ammonia supplied from the first treatment unit to the second treatment unit is compensated, and the concentration of nitrous oxide and the concentration of NOx contained in the flue gas that has passed through the second treatment unit can be reduced.

The flue gas treatment device according to the present disclosure may be configured to include: a temperature detection unit configured to determine a temperature of the flue gas from the first treatment unit; and a second supply unit (55) configured to supply ammonia or urea water into the flue gas supplied from the combustion device to the first treatment unit when the temperature determined by the temperature detection unit is lower than or equal to a predetermined temperature.

According to the flue gas treatment device of the present configuration, ammonia or urea water is supplied into the flue gas supplied from the combustion device to the first treatment unit, and thereby an exothermic reaction due to decomposition of ammonia in the first treatment unit can be promoted. Accordingly, the temperature of the flue gas guided from the first treatment unit to the second treatment unit can be suitably increased to operate the nitrogen oxide decomposition unit within a temperature range that does not cause a change in the decomposition rate of nitrous oxide due to the concentration of NO contained in the flue gas.

The flue gas treatment device according to the present disclosure may be configured to include a third treatment unit (30) configured to decompose ammonia contained in the flue gas that passed through the second treatment unit.

According to the flue gas treatment device of the present configuration, even when ammonia is contained in the flue gas that has passed through the second treatment unit, ammonia is suitably decomposed in the third treatment unit, and this can prevent ammonia from being exhausted externally.

The flue gas treatment device according to the present disclosure may be configured such that the predetermined temperature is a temperature that is higher than or equal to 450° C. and lower than or equal to 530° C.

According to the flue gas treatment device of the present configuration, because the predetermined temperature is higher than or equal to 450° C. and lower than or equal to 530° C., the nitrogen oxide decomposition unit can be operated within a suitable temperature range that does not cause a change in the decomposition rate of nitrous oxide due to the concentration of NO contained in the flue gas.

The flue gas treatment device according to the present disclosure is a flue gas treatment device (100B) configured to treat a flue gas from a combustion device that combusts fuel containing ammonia, and the flue gas treatment device includes: a first supply unit (50) configured to supply ammonia as a reducing agent into the flue gas from the combustion device; a nitrogen oxide decomposition unit (20) having a decomposition catalyst that reduces nitrous oxide and NOx contained in the flue gas by ammonia supplied from the ammonia supply unit; and an ammonia decomposition unit (30) configured to decompose ammonia contained in the flue gas that passed through the nitrogen oxide decomposition unit.

According to the flue gas treatment device of the present disclosure, ammonia contained in a flue gas from the combustion device reacts with nitrous oxide and NOx as a reducing agent and is decomposed by a decomposition catalyst when passing through the nitrogen oxide decomposition unit. Further, nitrous oxide and NOx produced when ammonia is combusted in the combustion device are suitably decomposed by the decomposition catalyst when passing through the nitrogen oxide decomposition unit. In such a way, according to the flue gas treatment device of the present disclosure, ammonia, nitrous oxide, and NOx contained in a flue gas from the combustion device that combusts fuel containing ammonia can be suitably decomposed.

The design method of a flue gas treatment device according to the present disclosure is a design method of a flue gas treatment device configured to treat a flue gas from a combustion device that combusts fuel containing ammonia, and the design method includes: designing the flue gas treatment device such that, when an concentration of ammonia contained in the flue gas is higher than a sum concentration of a first concentration and a second concentration, a first treatment unit having a first catalyst that decomposes ammonia contained in the flue gas is arranged downstream of the combustion device, and a second treatment unit having a second catalyst that decomposes nitrous oxide and NOx contained in the flue gas in which ammonia was decomposed by the first treatment unit is arranged downstream of the first treatment unit, the first concentration being obtained by multiplying a concentration of nitrous oxide contained in the flue gas by a first coefficient, and the second concentration being obtained by multiplying a concentration of NOx contained in the flue gas by a second coefficient; and designing the flue gas treatment device such that, when the concentration of ammonia contained in the flue gas is lower than or equal to the sum concentration, the second treatment unit is arranged without the first treatment unit being arranged downstream of the combustion device.

According to the design method of a flue gas treatment device of the present disclosure, a flue gas treatment device is designed such that, when the concentration of ammonia contained in a flue gas is higher than the sum concentration of the first concentration, which is obtained by multiplying the concentration of nitrous oxide contained in the flue gas by the first coefficient, and the second concentration, which is obtained by multiplying the concentration of NOx contained in the flue gas by the second coefficient, the first treatment unit is arranged downstream of the combustion device, and the second treatment unit is arranged downstream of the first treatment unit in order to prevent the concentration of ammonia supplied from the first treatment unit to the second treatment unit from becoming excessively high.

In contrast, when the concentration of ammonia contained in a flue gas is lower than or equal to the sum concentration of the first concentration, which is obtained by multiplying the concentration of nitrous oxide contained in the flue gas by the first coefficient, and the second concentration, which is obtained by multiplying the concentration of NOx contained in the flue gas by the second coefficient, the concentration of ammonia supplied from the first treatment unit to the second treatment unit does not become excessively high. Thus, the flue gas treatment device is designed so that the second treatment unit is arranged without the first treatment unit being arranged downstream of the combustion device. Accordingly, it is possible to design a flue gas treatment device having a suitable configuration in accordance with a concentration of ammonia contained in a flue gas from the combustion device.

REFERENCE SIGNS LIST

10 ammonia decomposition unit (first treatment unit)
20 nitrogen oxide decomposition unit (second treatment unit)
30 ammonia decomposition unit (third treatment unit)
40 detection unit
50 first supply unit (reducing agent supply unit)
55 second supply unit (fuel supply unit)
60 temperature sensor
70 bypass valve
80 control unit
90 bypass valve
100, 100A, 100B, 100C, 100D flue gas treatment device
200 combustion device
L1, L2, L3, L4, L5, L6, L7, L8 pipe

The invention claimed is:

1. A flue gas treatment device configured to treat a flue gas from a combustion device that combusts fuel containing ammonia, the flue gas treatment device comprising:

a first treatment unit having a first catalyst that decomposes ammonia contained in the flue gas;

a second treatment unit having a second catalyst that decomposes nitrous oxide and NOx contained in the flue gas in which ammonia was decomposed by the first treatment unit;

a detection unit configured to determine a concentration of nitrous oxide contained in the flue gas that passed through the second treatment unit; and a first supply unit configured to supply ammonia or urea water into the flue gas supplied from the first treatment unit to the second treatment unit when the concentration of nitrous oxide contained in the flue gas is higher than a first predetermined concentration, wherein the second catalyst is a catalyst that reduces and decomposes nitrous oxide contained in the flue gas by ammonia, and wherein the first treatment unit removes, by the first catalyst, NOx produced when ammonia contained in the flue gas is decomposed.

2. The flue gas treatment device according to claim 1, further comprising:

a bypass pipe configured to guide, to the second treatment unit, the flue gas from the combustion device without causing the flue gas to pass through the first treatment unit; and a bypass valve arranged on the bypass pipe.

3. The flue gas treatment device according to claim 1, further comprising a third treatment unit configured to decompose ammonia contained in the flue gas that passed through the second treatment unit.

4. The flue gas treatment device according to claim 1, wherein the detection unit is to measure a concentration of NOx contained in the flue gas that passed through the second treatment unit, the first supply unit is configured to supply ammonia or urea water into the flue gas supplied from the first treatment unit to the second treatment unit when the concentration of NOx contained in the flue gas is higher than a second predetermined concentration, wherein the second catalyst is a catalyst that reduces and decomposes NOx contained in the flue gas by ammonia.

5. The flue gas treatment device according to claim 4, further comprising:

a temperature detection unit configured to determine a temperature of the flue gas from the first treatment unit; and a second supply unit configured to supply ammonia or urea water into the flue gas supplied from the combustion device to the first treatment unit when the temperature determined by the temperature detection unit is lower than or equal to a predetermined temperature.

6. The flue gas treatment device according to claim 5 further comprising a third treatment unit configured to decompose ammonia contained in the flue gas that passed through the second treatment unit.

7. The flue gas treatment device according to claim 5, wherein the predetermined temperature is a temperature that is higher than or equal to 450° C. and lower than or equal to 530° C.

* * * * *